US010779671B1

(12) United States Patent
Hubbard

(10) Patent No.: US 10,779,671 B1
(45) Date of Patent: Sep. 22, 2020

(54) PACKAGE STORAGE SYSTEM

(71) Applicant: Brently Frederick Hubbard, Sacramento, CA (US)

(72) Inventor: Brently Frederick Hubbard, Sacramento, CA (US)

( * ) Notice: Subject to any disclaimer, the term of this patent is extended or adjusted under 35 U.S.C. 154(b) by 0 days.

(21) Appl. No.: 16/423,059

(22) Filed: May 27, 2019

(51) Int. Cl.

| | |
|---|---|
| ***A47G 29/14*** | (2006.01) |
| ***B65D 55/14*** | (2006.01) |
| ***B65D 43/16*** | (2006.01) |
| ***A47G 29/20*** | (2006.01) |
| ***B65D 25/28*** | (2006.01) |

(52) U.S. Cl.
CPC ..... *A47G 29/141* (2013.01); *A47G 29/20* (2013.01); *B65D 25/2835* (2013.01); *B65D 43/165* (2013.01); *B65D 55/14* (2013.01); *B65D 2543/00537* (2013.01)

(58) Field of Classification Search
CPC .... A47G 29/141; A47G 29/20; A47G 29/124; A47G 29/16; A47G 2029/144; A47G 2029/148; B65D 25/2835; B65D 43/165; B65D 55/14; B65D 2543/00537; B65F 1/1623; B65F 1/1615; B65F 1/1646
USPC ..... 232/19, 17, 45; 340/569, 568.1; 220/756, 263, 318, 811, 812; 70/63, 160
See application file for complete search history.

(56) References Cited

U.S. PATENT DOCUMENTS 1,997,707 A * 4/1935 Unger ..... A47G 29/20 232/41 R
5,979,750 A * 11/1999 Kindell ..... A47G 29/141 232/1 R
6,375,070 B1 * 4/2002 Snoke ..... A47G 29/141 232/20
6,669,023 B2 * 12/2003 Kikuchi ..... B42F 7/145 206/307
7,175,071 B1 * 2/2007 Slagle ..... A47G 29/16 220/833
7,743,935 B2 * 6/2010 Maid ..... A47G 29/20 220/210
8,358,199 B2 * 1/2013 Nesling ..... A47G 29/141 232/20
9,596,952 B2 * 3/2017 Mencel ..... A47G 29/20
9,630,757 B1 * 4/2017 Capous ..... B65D 55/14
10,039,401 B1 * 8/2018 Romanucci ..... A47C 7/628
10,383,471 B1 * 8/2019 Barnes ..... A47G 29/16
2005/0253715 A1 * 11/2005 Awobue ..... A47G 29/1214 340/569
2006/0196780 A1 * 9/2006 Horngren ..... G08B 13/06 206/1.5

(Continued)

*Primary Examiner* — William L Miller
(74) *Attorney, Agent, or Firm* — Michael D. Eisenberg

(57) ABSTRACT

A storage system for receiving and storing a package is provided, the storage system comprising a bin, a lid, a locking mechanism, an unlocking mechanism. The bin is configured for receiving the package. The lid is hingedly joined to a back of the bin, and configured for closing the bin. The locking mechanism comprises a first device joined to a front wall of the bin and a second device joined to the lid, and is configured for automatically locking the first device to the second device, thereby locking the lid with the front wall of the bin when the lid closes the bin. The unlocking mechanism is accessible to a recipient of the package and configured for unlocking the first device from the second device in response to an action by the recipient, thereby unlocking the lid from the front of the bin.

18 Claims, 25 Drawing Sheets

(56) References Cited

U.S. PATENT DOCUMENTS

| | | | | |
|---|---|---|---|---|
| 2010/0252468 | A1* | 10/2010 | Pratte | A61L 2/26 206/363 |
| 2018/0029760 | A1* | 2/2018 | Maser | G07C 9/00896 |
| 2018/0070753 | A1* | 3/2018 | Eveloff | H04W 12/08 |
| 2019/0167025 | A1* | 6/2019 | Cherry | A47G 29/141 |
| 2019/0239673 | A1* | 8/2019 | Silva | A47G 29/28 |

* cited by examiner

100

100

100

900

PACKAGE STORAGE SYSTEM

TECHNICAL FIELD

This invention relates to the field of package deliveries, and more particularly to bins for storing delivered package:

BACKGROUND OF THE INVENTION

As online shopping has grown, the number of package deliveries to the recipient's home has rapidly increased. Packages are often delivered when the recipient is not at home. In such instances, the delivery person leaves the package outside the recipient's porch. This phenomenon has given rise to porch package theft. Some thieves make their rounds around residential neighborhoods, looking for packages left outside houses; and steal the packages before the recipients return to their homes. Other thieves follow delivery trucks and wait until the delivery person has placed the package on the porch and has driven away, before stealing the package.

The present invention addresses this problem.

BRIEF SUMMARY OF EMBODIMENTS OF THE INVENTION

The present invention, in some embodiments thereof, relates to a package storage system that provides a solution to porch package theft.

Therefore, an aspect of some embodiments of the present invention relates to a storage system for receiving and storing a package; the storage system comprises a bin, a lid, a locking mechanism; and an unlocking mechanism. The bin is configured for receiving the package. The lid is hingedly joined to a back of the bin, and configured for closing the bin. The locking mechanism includes a first device joined to a front wall of the bin and a second device joined to the lid, and is configured for automatically locking the first device to the second device, thereby locking the lid with the front wall of the bin when the lid closes the bin. The unlocking mechanism is accessible to a recipient of the package and is configured for unlocking the first device from the second device in response to an action by the recipient, thereby unlocking the lid from the front of the bin.

In a variant, the bin is configured to be secured to a horizontal floor and/or a vertical wall outside a residence of the recipient.

In another variant, the storage system includes at least one hinge bracket joined to an outer surface of a back wall of the bin. The hinge bracket includes an elongated panel extending away from the back wall of the bin, the elongated panel extending substantially vertically and having a slit closed at both ends and extending vertically in the panel. The lid comprises a pin extending horizontally in proximity of a back of the lid. The slit of the hinge bracket is configured to be traversed by the pin, thereby joining the lid to the bin, while constraining a motion of the lid to vertical motion along the slit and rotational motion around the pin.

In yet another variant, the storage system further comprises a lid retainer joined to a first side or to a back of the bin in proximity of the first side, the lid retainer extending backwards away from the bin for a certain extension length and bending toward a second side of the bin opposite to the first side at an end of the extension length, such that the lid retainer prevents the lid from rotating backward when the pin of the lid is below the lid retainer.

The lid retainer may be above a bottom end of the slit and below a top end of the slit.

In some embodiments of the present invention, the first device of the locking mechanism comprises a latch joined to an inner surface of the front wall of the bin. The second device comprises a hasp joined to the lid and located near a front of the lid. The hasp comprises a flat panel extending away from lid toward the bin, the flat panel having an aperture. The latch comprises a bottom section a middle section, a top section, a prong. The bottom section is parallel to the front wall of the bin and is joined to an inner face of the front wall of the bin. The middle section is oriented diagonally backward with respect to the bottom section, at a first non-zero angle with respect to the bottom section. The top section is oriented diagonally forward with respect to the middle section, at a second non-zero angle with respect to the middle section. The prong extends forward from a front face of the top section to contact the front wall of the bin, the prong having a top side inclined downwards from a top of the top section toward the front wall of the bin and a bottom side. As the front of the lid approaches the front wall of the bin, the hasp is configured to slide along the inclined top side of the prong and move the top section and the middle section of the latch backwards, away from the front wall of the bin, until the aperture of the hasp is aligned with the prong, at which point, the prong traverses the aperture and the latch is configured to snap back to return toward front wall. Once the prong is caught in the aperture of the hasp, lifting the lid causes the hasp to be push upwards against the bottom side of the prong. The bottom side of the prong is oriented such that, when the hasp pushes upwards against the bottom side of the prong, the bottom side of the prong provides resistance against the upward movement of the prong and prevents the hasp from disengaging from the prong.

In a variant, the hasp comprises a flap extending at a third non-zero angle from a bottom of the panel downwards and backwards toward a back of the lid, the flap being configured to guide the hasp in a space between the latch and the front wall of the bin.

In another variant, the unlocking mechanism comprises a turning unit and an unlatcher. The turning unit is accessible to the recipient. The unlatcher is a located inside the bin, between the latch and the front wall of the bin. In a first mode of the unlocking mechanism, the unlatcher is located in a void between the latch and the front wall of the bin. In a second mode of the unlocking mechanism, the unlatcher is rotated to contact the top section of the latch and is configured to push the middle section and the top section backwards so the prong is pushed out of the aperture of the hasp, thereby disengaging the hasp from the prong and enabling the lid to be opened. The turning unit is configured to turn the unlatcher between the first mode and the second mode via an action of the recipient.

In yet another variant, the turning unit comprises a handle and a key mechanism. The handle is located outside the front wall of the bin, and configured to be rotated, the handle being joined to the unlatcher via an opening in the front wall of the bin, such that a rotation of the handle in a rotation direction causes the unlatcher to rotate in the rotation direction. The key mechanism has a keyhole associated with handle, such that the handle is able to be turned only when a key in possession of the recipient is inserted in the keyhole and turned.

In a further variant, the turning unit comprises an automatic unit or a keypad. The automatic unit is configured for turning the unlatcher in response to an electromagnetic signal emitted by a controller in possession of the recipient.

The keypad is located outside the bin and configured to rotate the unlatcher when the recipient enters a predetermined code in possession of the recipient.

Another aspect of some embodiments of the present invention relates to a storage system for receiving and storing a package, the storage system comprising, a bin, at least one divider panel, a plurality of lids, a plurality of locking mechanisms, and a plurality of unlocking mechanisms. The bin is configured for receiving the package. Each divider panel is configured to divide the bin into distinct storage sections. The lids are hingedly joined to a back of the bin and configured for closing respective portion of the bin, each portion corresponding to one of a storage section or a part of one of the storage section. Each locking mechanism comprises a first device joined to a front wall of the bin the bin and a second device joined to a respective one of the lids, and each locking mechanism being configured for automatically locking the respective first device with the respective second device, thereby locking the respective lid with the front wall of the bin when the respective lid closes the bin. Each unlocking mechanism is accessible to a recipient of the package and configured for unlocking a respective one of the first devices from a respective one of the second devices in response to an action by the recipient, thereby unlocking a respective one of the lids from the front wall of the bin.

In a variant, the bin is configured to be secured to a horizontal floor and/or a vertical wall outside a residence of the recipient.

In another variant, the storage system includes at least one hinge bracket for each lid, the hinge brackets being joined to an outer surface of a back wall of the bin. Each hinge bracket comprises an elongated panel extending away from the back wall of the bin, the elongated panel extending substantially vertically and having a slit closed at both ends and extending vertically in the panel. Each lid comprises a pin extending horizontally in proximity of a back of the pin. The slit of the hinge bracket is configured to be traversed by the pin, thereby joining the lid to the bin, while constraining a motion of the lid to vertical motion along the slit and rotational motion around the pin.

In some embodiments of the present invention, the first device of the locking mechanism comprises a latch joined to an inner surface of the front wall of the bin. The second device comprises a hasp joined to the lid and located near a front of the lid. The hasp comprises a flat panel extending away from lid toward the bin, the flat panel having an aperture. The latch comprises a bottom section a middle section, a top section, a prong. The bottom section is parallel to the front wall of the bin and is joined to an inner face of the front wall of the bin. The middle section is oriented diagonally backward with respect to the bottom section, at a first non-zero angle with respect to the bottom section. The top section is oriented diagonally forward with respect to the middle section, at a second nonzero angle with respect to the middle section. The prong extends forward from a front face of the top section to contact the front wall of the bin, the prong having a top side inclined downwards from a top of the top section toward the front wall of the bin and a bottom side. As the front of the lid approaches the front wall of the bin, the hasp is configured to slide along the inclined top side of the prong and move the top section and the middle section of the latch backwards, away from the front wall of the bin, until the aperture of the hasp is aligned with the prong, at which point, the prong traverses the aperture and the latch is configured to snap back to return toward front wall. Once the prong is caught in the aperture of the hasp, lifting the lid causes the hasp to be push upwards against the bottom side of the prong. The bottom side of the prong is oriented such that, when the hasp pushes upwards against the bottom side of the prong, the bottom side of the prong provides resistance against the upward movement of the prong and prevents the hasp from disengaging from the prong.

In a variant, the hasp comprises a flap extending at a third non zero angle from a bottom of the panel downwards and backwards toward a back of the lid, the flap being configured to guide the hasp in a space between the latch and the front wall of the bin.

In another variant, the unlocking mechanism comprises a turning unit and an unlatcher. The turning unit is accessible to the recipient. The unlatcher is a located inside the bin, between the latch and the front wall of the bin. In a first mode of the unlocking mechanism, the unlatcher is located in a void between the latch and the front wall of the bin. In a second mode of the unlocking mechanism, the unlatcher is rotated to contact the top section of the latch and is configured to push the middle section and the top section backwards so the prong is pushed out of the aperture of the hasp, thereby disengaging the hasp from the prong and enabling the lid to be opened. The turning unit is configured to turn the unlatcher between the first mode and the second mode via an action of the recipient.

In yet another variant, the turning unit comprises a handle and a key mechanism. The handle is located outside the front wall of the bin, and configured to be rotated, the handle being joined to the unlatcher via an opening in the front wall of the bin, such that a rotation of the handle in a rotation direction causes the unlatcher to rotate in the rotation direction. The key mechanism having a keyhole associated with handle, such that the handle is able to be turned only when a key in possession of the recipient is inserted in the keyhole and turned.

In a further variant, the turning unit comprises an automatic unit or a keypad. The automatic unit is configured for turning the unlatcher in response to an electromagnetic signal emitted by a controller in possession of the recipient. The keypad is located outside the bin and configured to rotate the unlatcher when the recipient enters a predetermined code in possession of the recipient.

In a variant, at least one divider panel is removable.

In some embodiments of the present invention, the removable divider panel comprises a plate and a slab. The plate serves a wall between the storage sections. The slab is joined to a top of the plate, the slab having a first protrusion rising upwards at a left side of the plate and a second protrusion rising upwards at a right side of the plate. When one of two lids adjacent to the removable divider pant is closed over a side of the removable divider panel, one of the protrusions is covered by the lid, preventing the removal of the removable divider panel until both lids adjacent to the removable panel are open.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

The present invention, in some embodiments thereof, relates to a package storage system that provides a solution to porch package theft.

The system of the resent invention is advantageous and practical for the following reasons:

1. The package is secure inside the system from theft, once delivered;

2. The delivery person is free from the burden of needing keys or combination to deliver the package;

3. The system is open to the delivery person and can be easily lockable by the delivery person;

4. The system's owner (i.e. the recipient of the package) is the sole custodian of the keys or combination needed to unlock and open the system;

5. The system is securable to the porch floor or the porch wall.

In some embodiments of the present invention, the system of the present invention also has one or more of the following features:

a. The system is able to accept multiple deliveries during the day, while securing previous deliveries from theft;

b. The system is adjustable to packages of different sizes;

c. The system is customizable to the needs of the recipient's needs, based on the daily deliveries the recipient expects.

Figure 1:
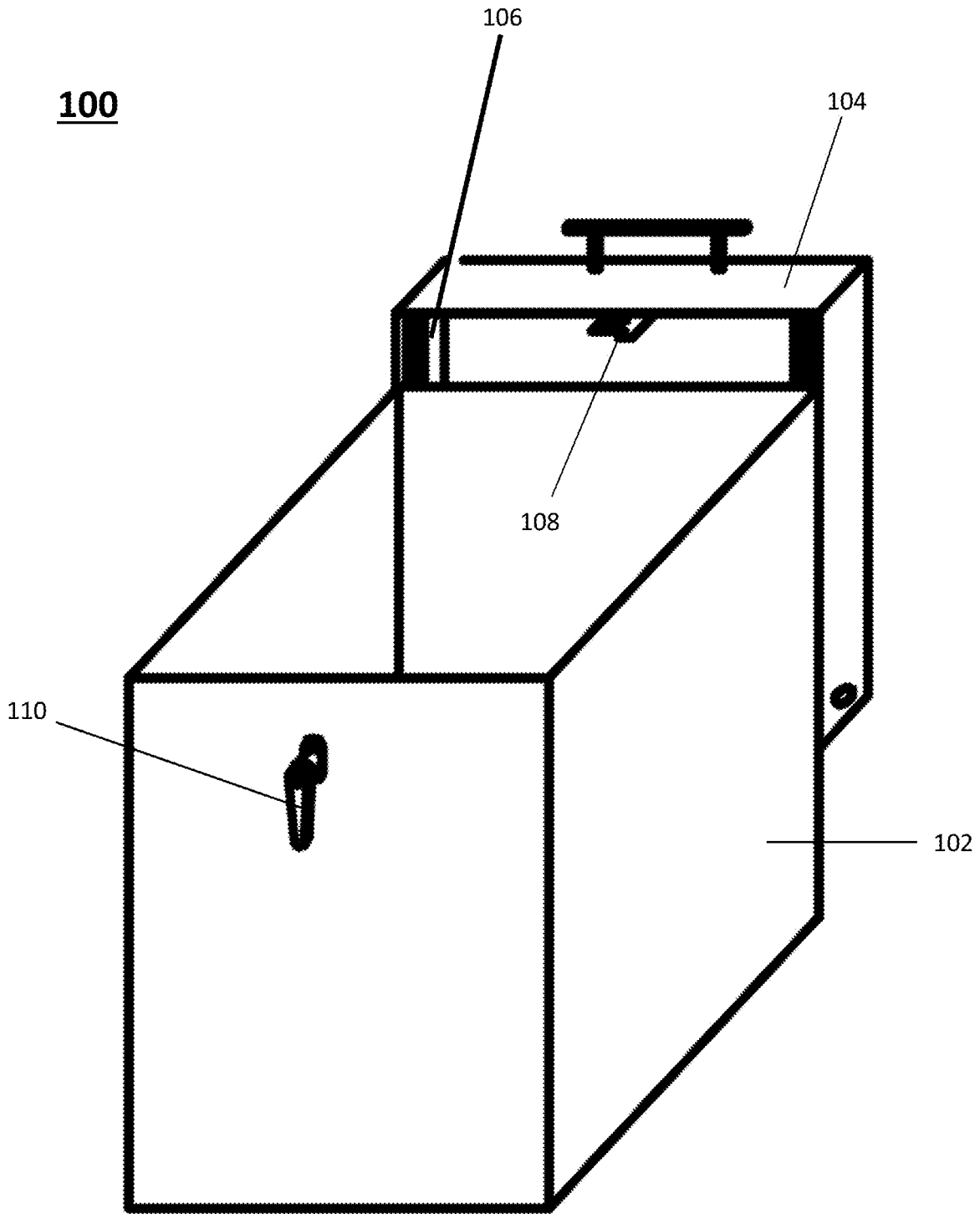
FIG. 1 is an isometric view of a single-bin package storage system, according to some embodiments of the present invention.

Referring now the drawings, FIG. 1 is an isometric view of a single-bin package storage system 100, according to some embodiments of the present invention.

The storage system 100 includes a bin 102, a lid 104, a lid guidance apparatus 106, a locking mechanism 108, and an unlocking mechanism 110.

The bin 102 is open, to enable the delivery person to deposit a package in the bin 102. The lid guidance apparatus 106 is joined to the bin 102 and configured for keeping the lid 104 coupled to the bin 102, while allowing the lid 104 to move so as to cover the bin and uncover the bin. The lid guidance apparatus hingedly joins the lid 104 to the back of the bin 102.

The locking mechanism is a keyless and codeless mechanism that locks the front of the lid 104 to front of the bin 102 when the lid 104 covers the top of the bin 102. Once the bin 102 is closed, it is automatically locked and may be unlocked only by the recipient via the unlocking mechanism 110. The unlocking mechanism 110 is only accessible to the recipient and is configured to unlock of the lid from the bin and requires an action of the recipient to be activated, such as using a key in the recipient's possession or entering a code in the recipient's possession.

Figure 2:
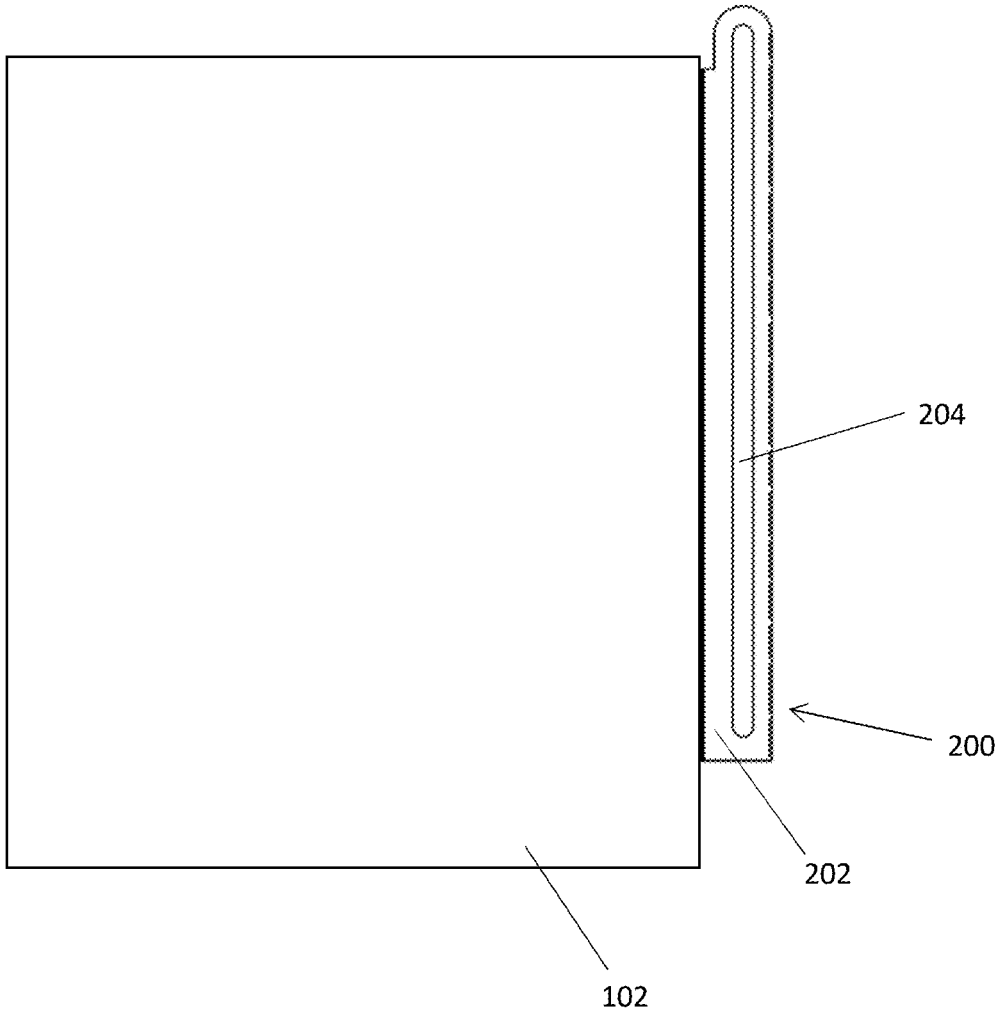
FIG. 2 is a side view illustrating a bin and a hinge bracket, according to some embodiments of the present invention.

FIG. 2 is a side view illustrating a bin 102 and a hinge bracket 200, according to some embodiments of the present invention.

One or more hinge brackets 200 form the lid guidance apparatus. The hinge bracket 200 includes an elongated panel 202 extending long a longitudinal axis. The panel 202 has an elongated slit 204 extending longitudinally and closed on both ends. The slit 204 is configured to be traversed by a pin joined to the lid, in order to enable movement of the pin within the slit 204, thereby enabling the movement of the lid, as will be explained further below.

One or more brackets 200 are joined to an outer surface of the back wall of the bin 102. In the embodiments in which more than one hinge bracket 200 is joined to the back of the bin 102, the slits 204 of the hinge brackets 200 are aligned to each other, to enable movement of the lid.

Figure 3A:
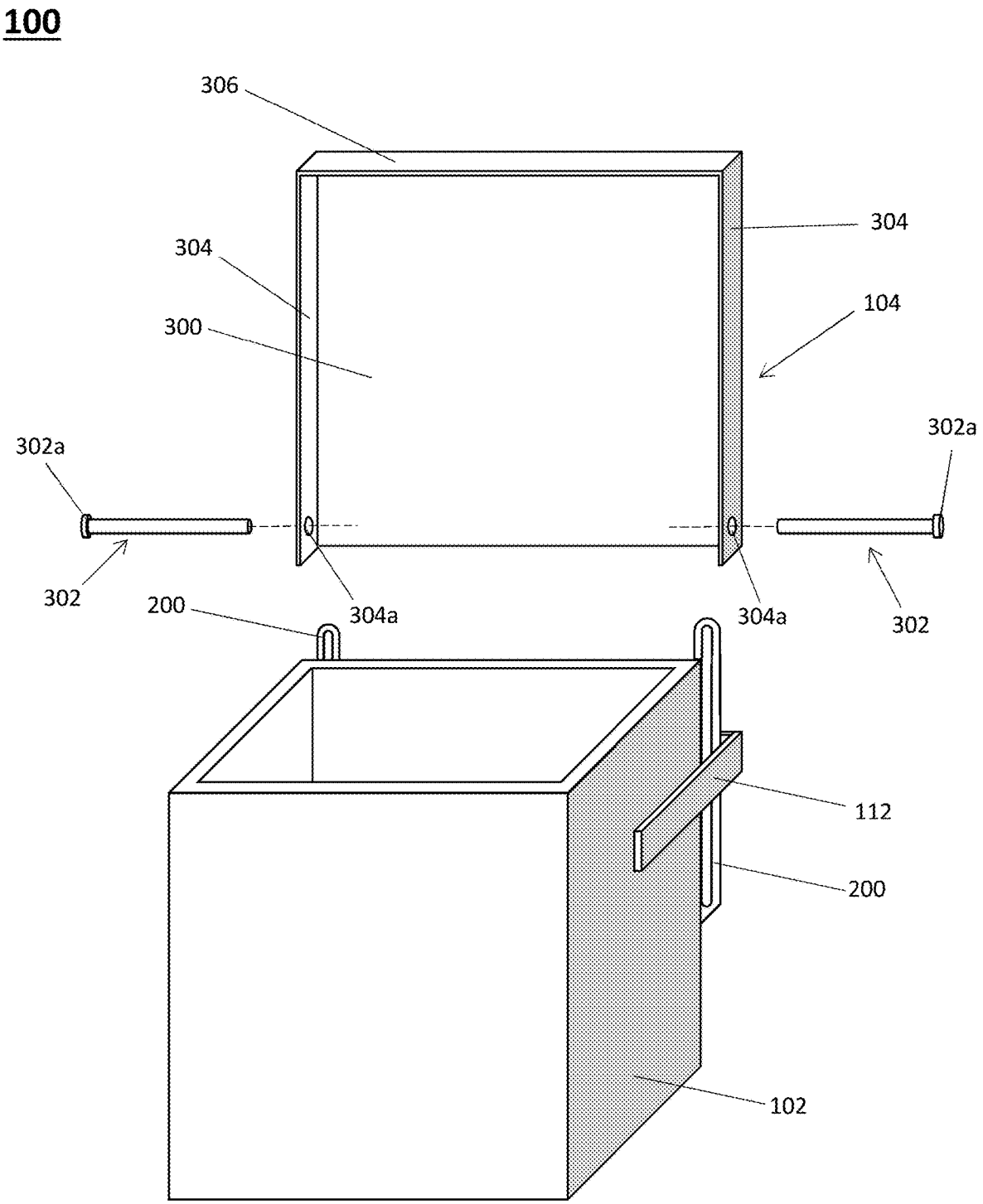
FIGS. 3*a*-3*c* is an isometric view illustrating a single-bin package storage system of the present invention, in which the lid is shown detached from the bin for clarity purposes.
Figure 3B:
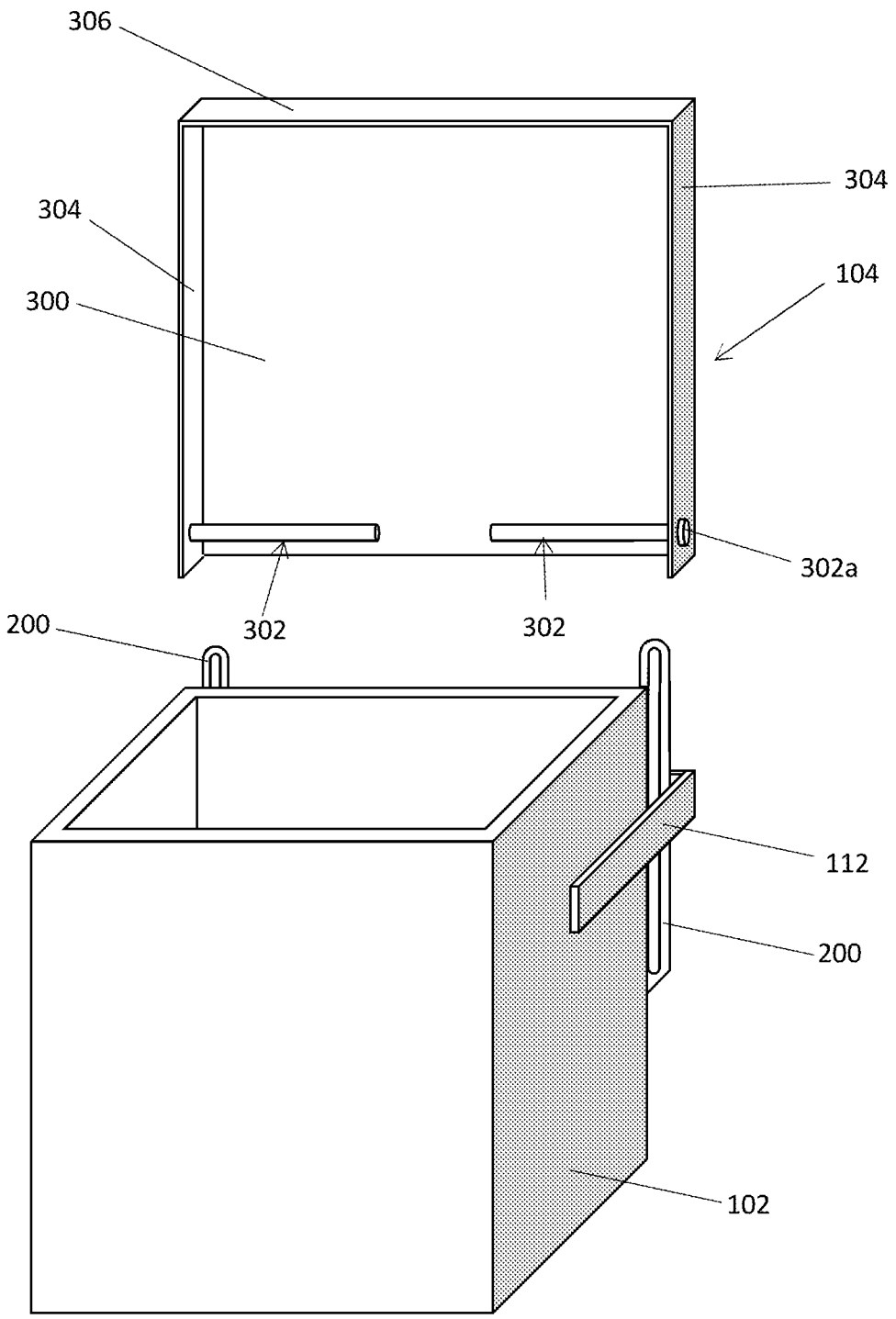
Figure 3C:
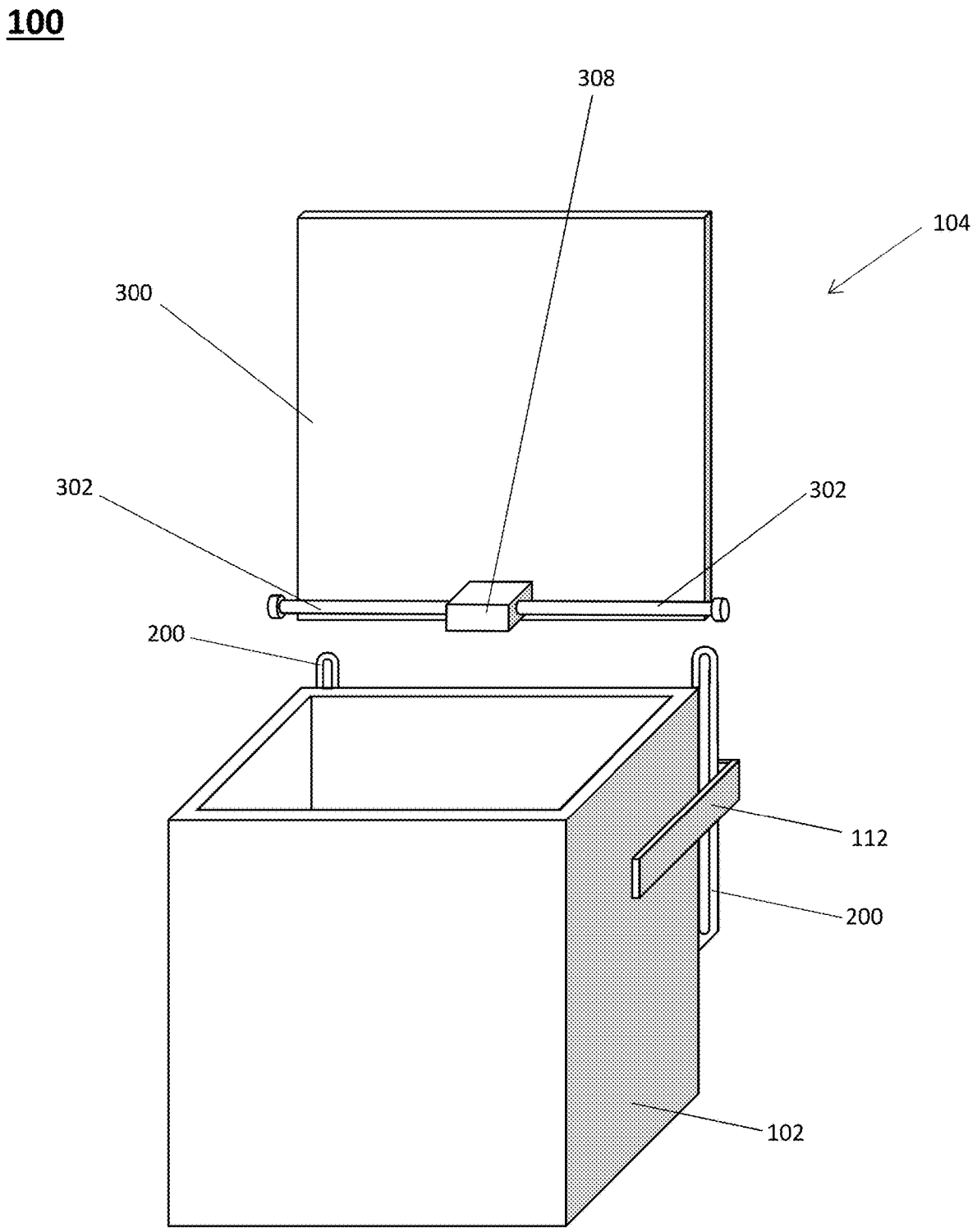
Figure 4:
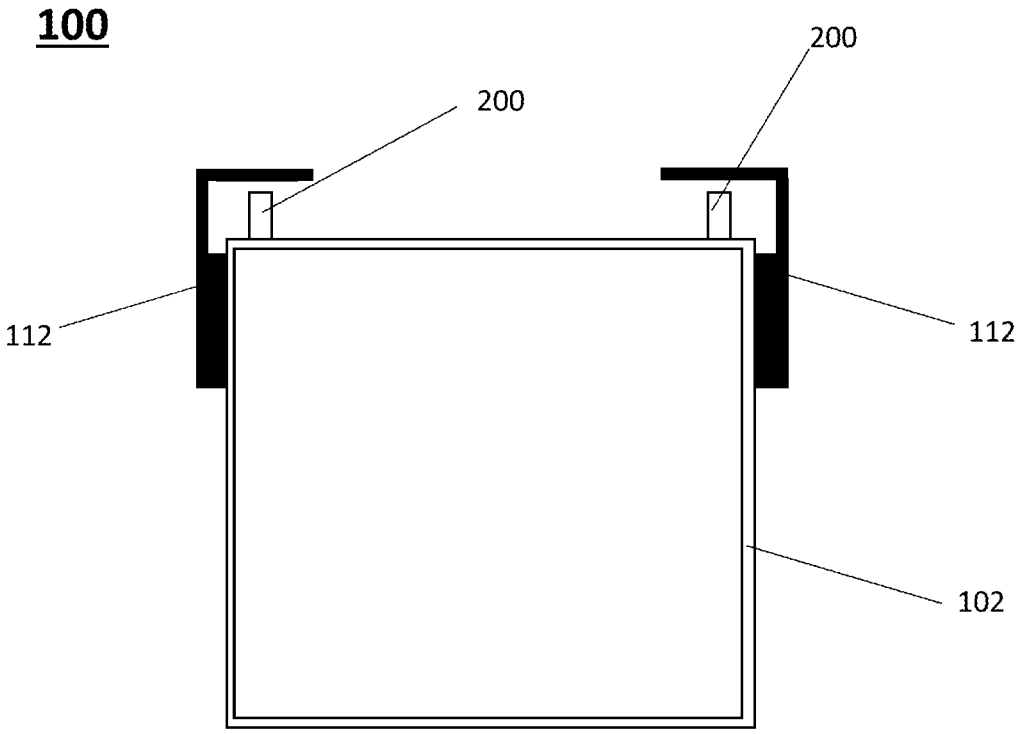
FIG. 4 is a top cross sectional view of the bin of a single-bin package storage system, according to some embodiment of the present invention.
Figure 5:
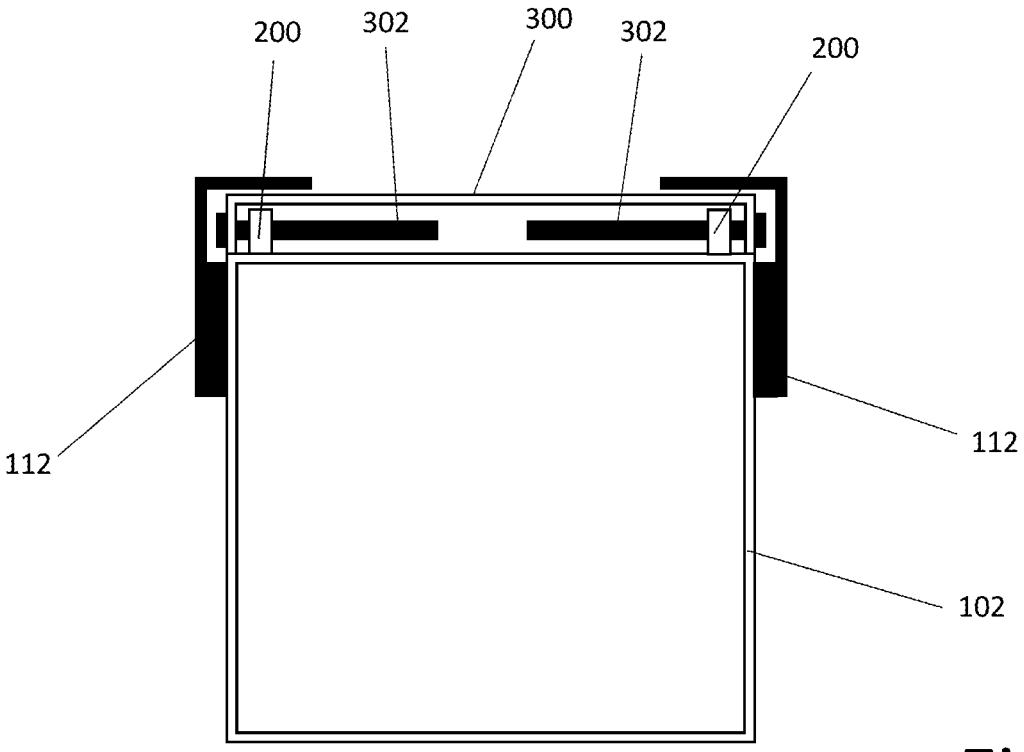
FIG. 5 is a top cross sectional view of the bin and lid of a single-bin package storage system, according to some embodiment of the present invention.

FIGS. 3*a*, 3*b*, and 3*c* are isometric view illustrating a single-bin package storage system 100 of the present invention, in which the lid 104 is shown detached from the bin 102 for clarity purposes. FIGS. 3*a* and 3*b* illustrate a first example of a lid, while FIG. 3*c* illustrates a second example of a lid. FIG. 4 is a top cross sectional view of the bin 102 of a single-bin package storage system 100, according to some embodiment of the present invention. FIG. 5 is a top cross sectional view of the bin 102 and lid 104 of a single-bin package storage system 100, according to some embodiment of the present invention.

The lid 104 include a sheet 300 and at least one pin 302 parallel to the sheet 300. The sheet 300 has a surface substantially matching the surface of the top cross section of the bin 102. In this manner, when the lid 104 closes the bin 102, access to the contents of the bin 102 is denied.

The one or more pins 302 are joined to the panel via an external unit, such that the pins 302 do not touch the sheet 300. The pins 302 are configured to traverse the slit(s) of the bracket(s) 200, thus coupling the lid 104 to the bin 102, while allowing the lid 102 to move along the slits. In the embodiments of FIGS. 3*a*-5, the system includes two hinge brackets 200 that are parallel to each other and perpendicular to the back surface of the bin 102.

In some embodiments of the present invention, the system 100 includes a lid retainer 112 joined to a first side of the bin 102 or to the back of the bin, proximal to the first side of the bin. The lid retainer 112 extends backwards for a certain extension length and, at the end of the extension length, bends horizontally toward the second side (opposite to the first side) of the bin 102 in order to provide support for the lid 104 to prevent the lid from rotating backwards. The height of lid retainer is between the height of the bottom end of the slit 204 and the height of the top end of the slit 204. In some embodiments of the present invention, the system 100 includes two lid retainers 112, each joined to a respective side of the bin 102 and bending toward the opposing side of the bin, as seen in FIGS. 4 and 5.

In the example of FIGS. 3*a* and 3*b*, the lid 104 includes three walls extending from the perimeter of the sheet 300: two side walls 304 and a front wall 306. The back side of the sheet's perimeter does not have a wall. A wall at the back side of the sheet's perimeter would prevent the lid 104 from sliding along the slit. The pins 302 are held by the side walls 304, near the back side of the sheet 300. In some embodiments of the present invention, at least one of the side walls includes a hole 304*a*, while each pin includes a pin head 302*a* having a cross section area larger than the cross sectional area of the rest of the pin. The pin 302 is configured for traversing the hole 304*a*, except for the pin head 302, which is too large to traverse the hole 304*a*. The pins heads are joined to the walls, fear example by melding each pin head to the respective wall or by screwing a nut to the portion of the pin inside the lid and tightening the nut against the respective side wall 304. In the embodiments in which the pins have pin heads extending laterally from the side walls 304, the lid retainers 112 are shaped to accommodate the pin heads and allowing the pin heads to clear the lid retainers 112.

In the example of FIG. 3*c*, the lid does not have any walls. Instead, a coupling 308 joins two pins 302 the bottom face of the sheet 300 so that one of the pins 302 faces toward the left side of the lid, while the other one of the pins faces toward the right side of the lid. The coupling 308 keeps the pins 302 in place on the lid and keeps the pins 302 at a desired distance from the sheet 300.

FIGS. 6-9 are cross sectional side views illustrating the closure of a single-bin package storage system 100, according to some embodiments of the present invention.

Figure 6:
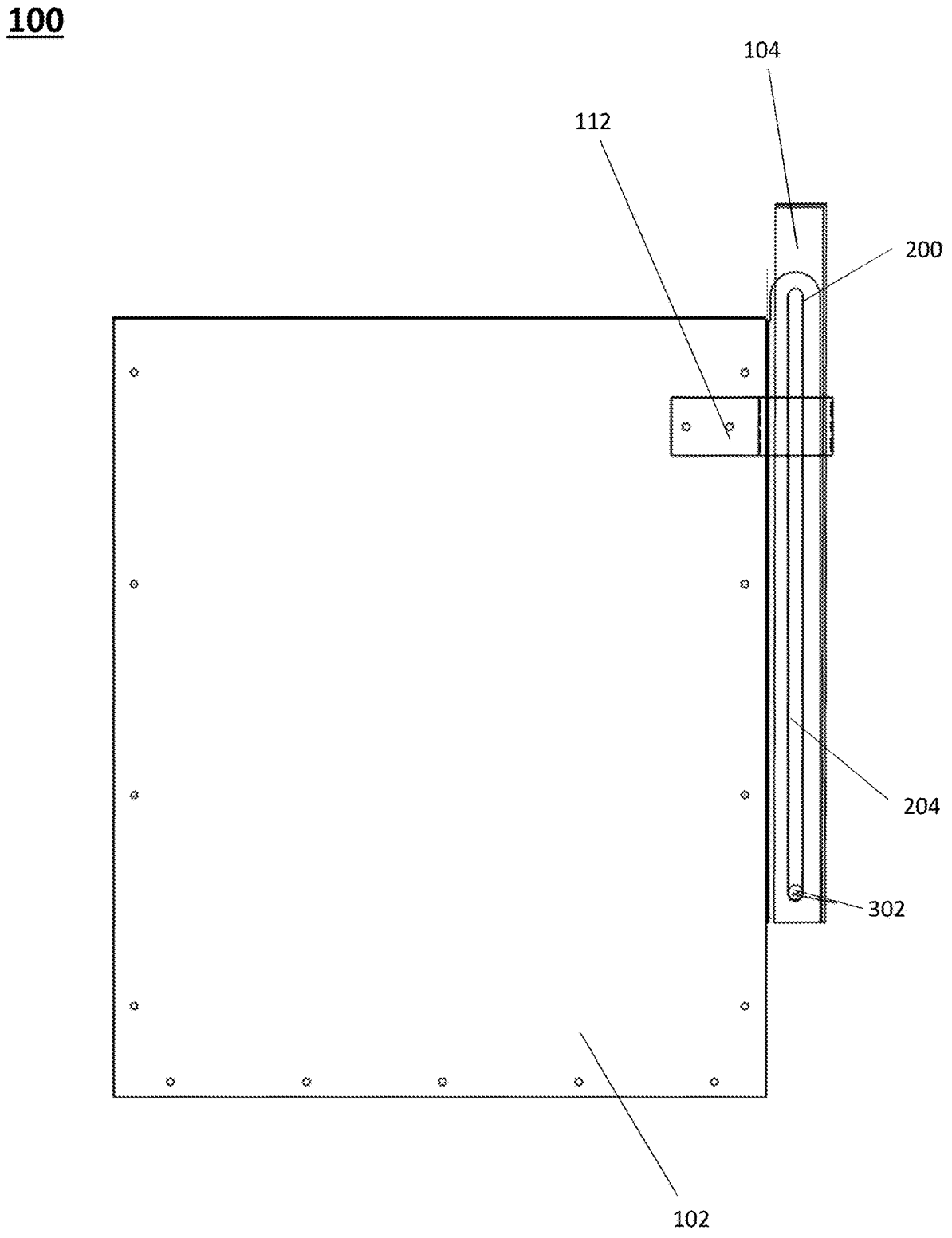
FIGS. 6-9 are cross sectional side views illustrating the closure of a single-bin package storage system, according to some embodiments of the present invention.

In FIG. 6, the lid 104 is tucked behind the bin 102 and is in a substantially vertical orientation. The pin 302 is at the bottom end of the slit 204 of the hinge bracket 200. The lid 104 can rotate around the pin in the slit 204. Optionally, the lid retainer 112 is present to prevent the lid to rotate backwards (clockwise in the example) and maintain the lid vertical when tucked behind the bin 102.

Figure 7:
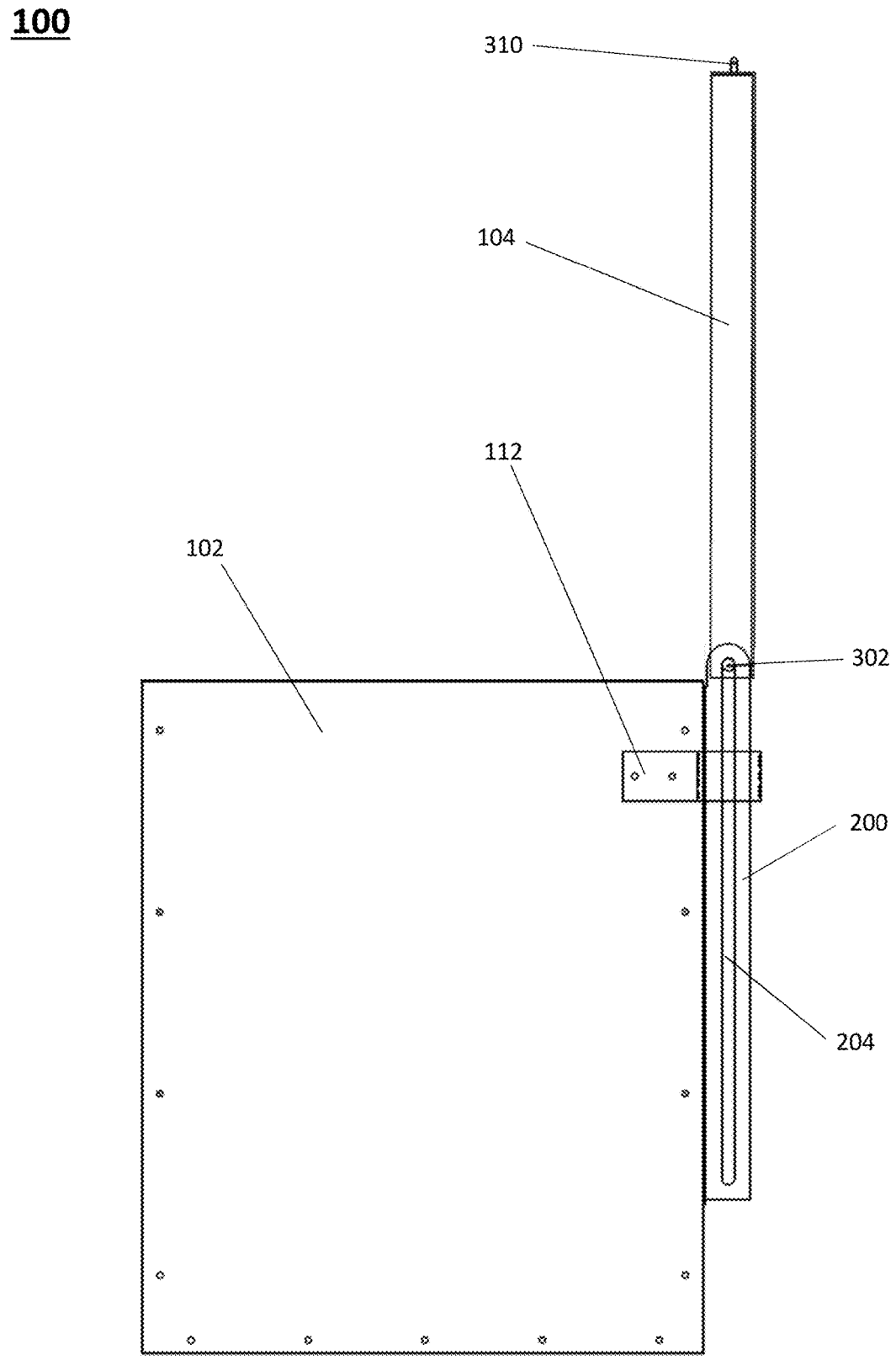

In FIG. 7, a parcel/package has been placed in the bin 102 and the bin 102 is to be closed. The lid 104 has been pulled upwards so the pin 302 is at the top end of the slip 204 of the bracket 200. The lid has cleared the lid retainer 112 and the rim of the bin 102. Thus, the lid 104 can now be rotated about the pin 302 in order to cover the top of the bin 102. In some embodiments of the present invention, the lid 104 includes a handle 310 at the front of the lid. The handle 310 makes is a gripping point and makes it easier to handle the lid 104.

Figure 8:
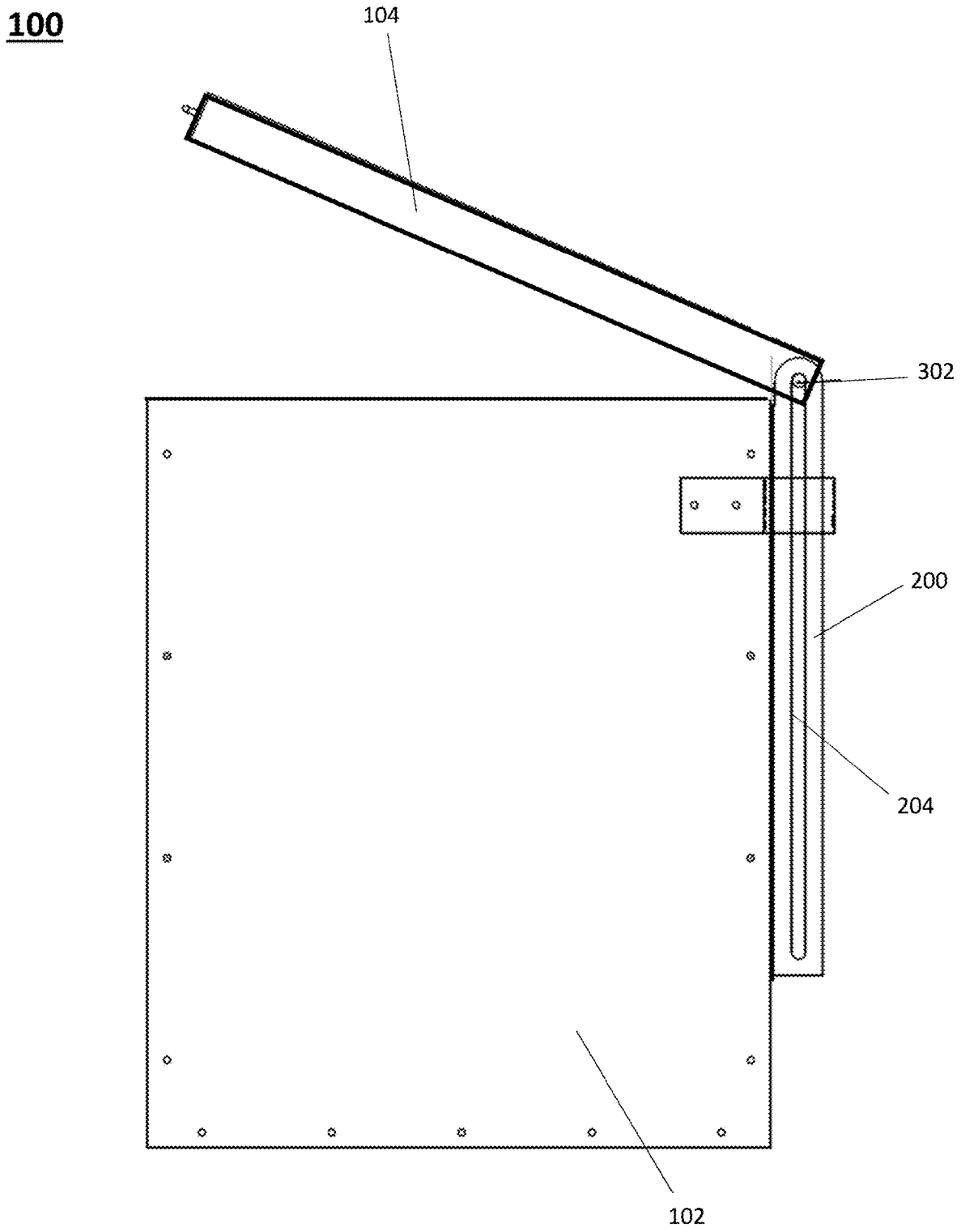
Figure 9:
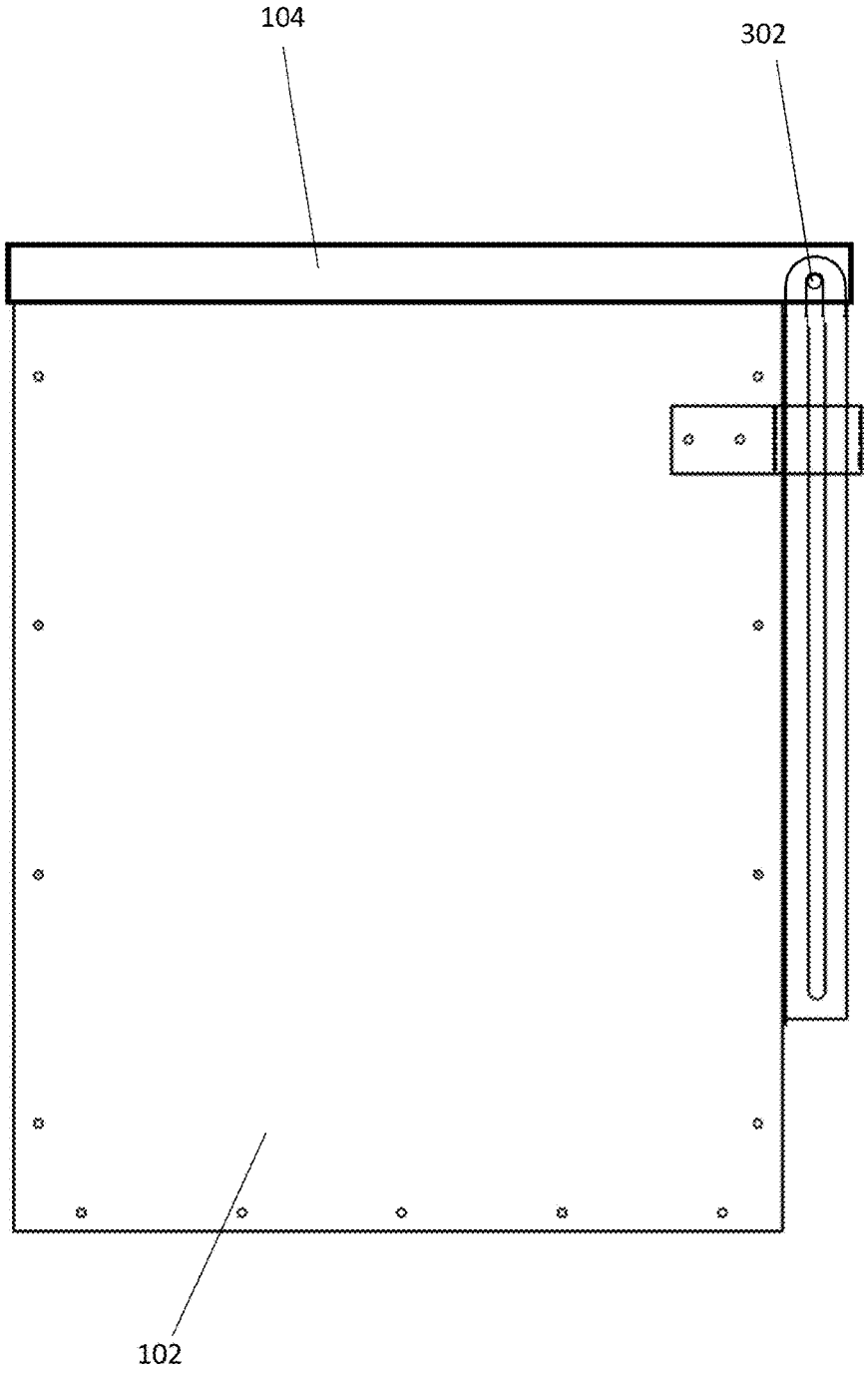

In FIG. 8, the lid 104 has been rotated counterclockwise around the pin 302 to cover the top of the bin 102. In FIG. 9, the lid 104 covers the bin 102 and is supported by the rim of the bin 102.

In some embodiments of the present invention, the system of the present invention includes a locking mechanism which locks the lid to the bin when the lid closes the bin. This obviates the need for the delivery person to have keys or a code to lock the system. Once the lid and bin are locked together, the lid can be unlocked from the bin via an unlocking mechanism accessible to the recipient via a key or a code. FIGS. 10-18 relate to examples of the locking mechanism and unlocking mechanism.

Figure 10:
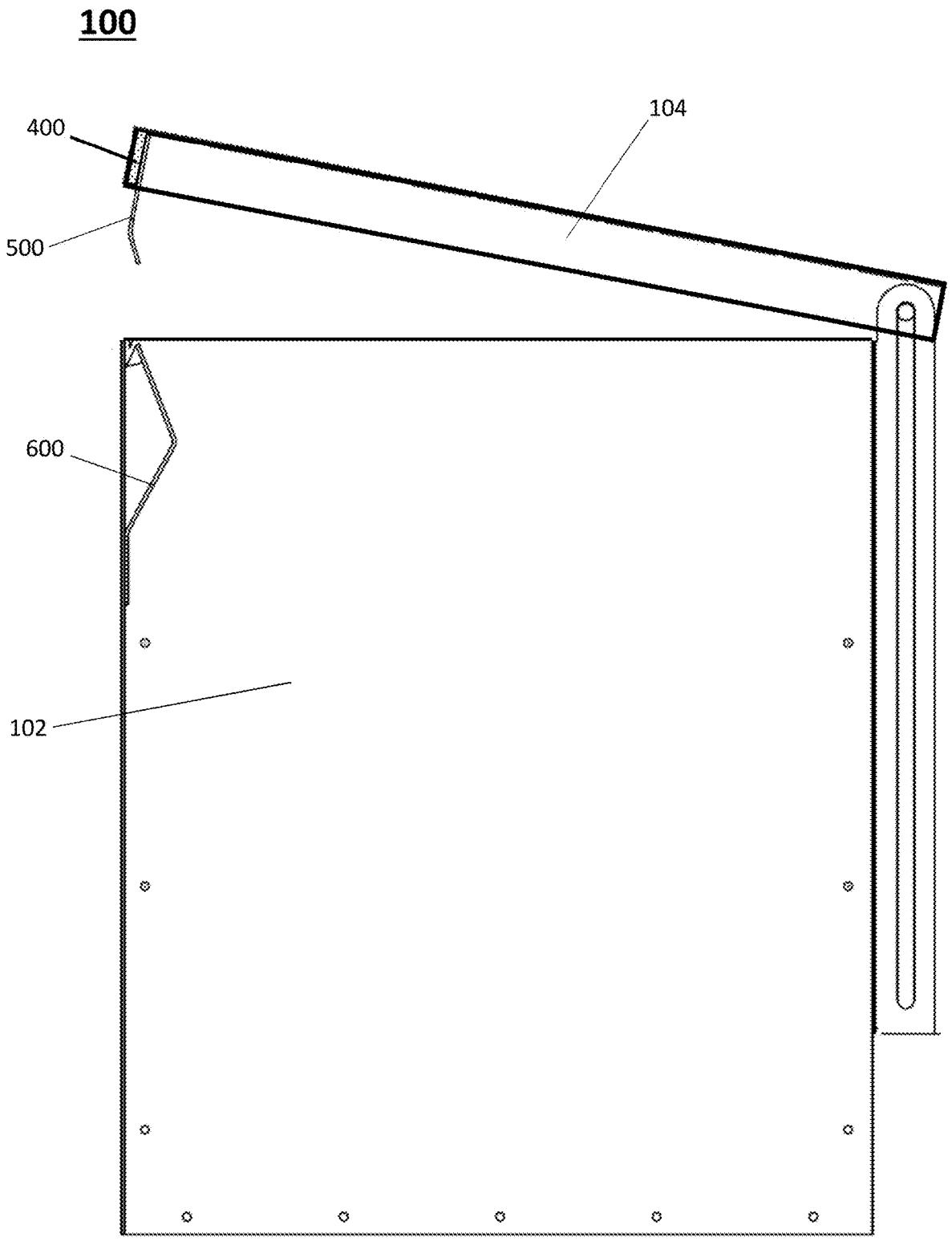
FIG. 10 is a cross sectional side view illustrating a locking mechanism for locking the lid on the bin is a package storage system of the present invention.

FIG. 10 is a cross sectional side view illustrating a locking mechanism for locking the lid 104 to the bin 102 in the package storage system 100 of the present invention. The locking mechanism includes a hasp 500 and a latch 600.

The hasp 500 is joined to the lid 104 and is located near the front of the lid 104. If the lid 104 includes a front wall, the hasp 500 is joined to the inner face of the front wall. In some embodiments of the present invention, the locking mechanism includes a hasp spacer 400 located between the front wall and the hasp 500, in order to place the hasp 500 at a desired distance from the front wall.

The latch 600 is joined to the inner side of the front wall of the bin 102. When the lid 104 closes the bin 102 the hasp 500 and the latch 600 engage with each other and lock in with each other. Raising the lid 104 from the bin 102 does not disengage the hasp from the latch. An unlocking mechanism accessible to the recipient is needed for disengaging the hasp from the latch, thereby enabling the opening of the bin.

Figure 11:
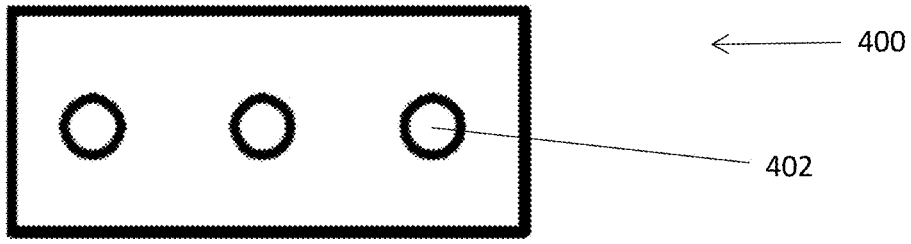
FIG. 11 is front view of a hasp spacer of the locking mechanism, according to some embodiments of the present invention.

FIG. 11 is front view of a hasp spacer 400 of the locking mechanism, according to some embodiments of the present invention.

The hasp spacer 400 includes a panel having a desired thickness to place the hasp at a desired distance from the front wall of the lid. The hasp spacer is configured to be placed between the front wall of the lid and hasp, in order to set hasp at a desired distance from the front wall of the lid.

The hasp spacer 400 may joined to the front wall of the lid and to the hasp by any known mechanism. In some embodiments of the present invention, the hasp spacer 400 has at least one hole 402 traversing the panel and configured to be traversed by a screw or bolt. The front wall of the lid and the hasp have respective holes. The hold of the hasp spacer 400 is aligned to the hold of the hasp and of the lid's front wall, and screw or bolt is driven through the above holes to join the hasp spacer 400, the lid's front wall, and the hasp together.

Figure 12:
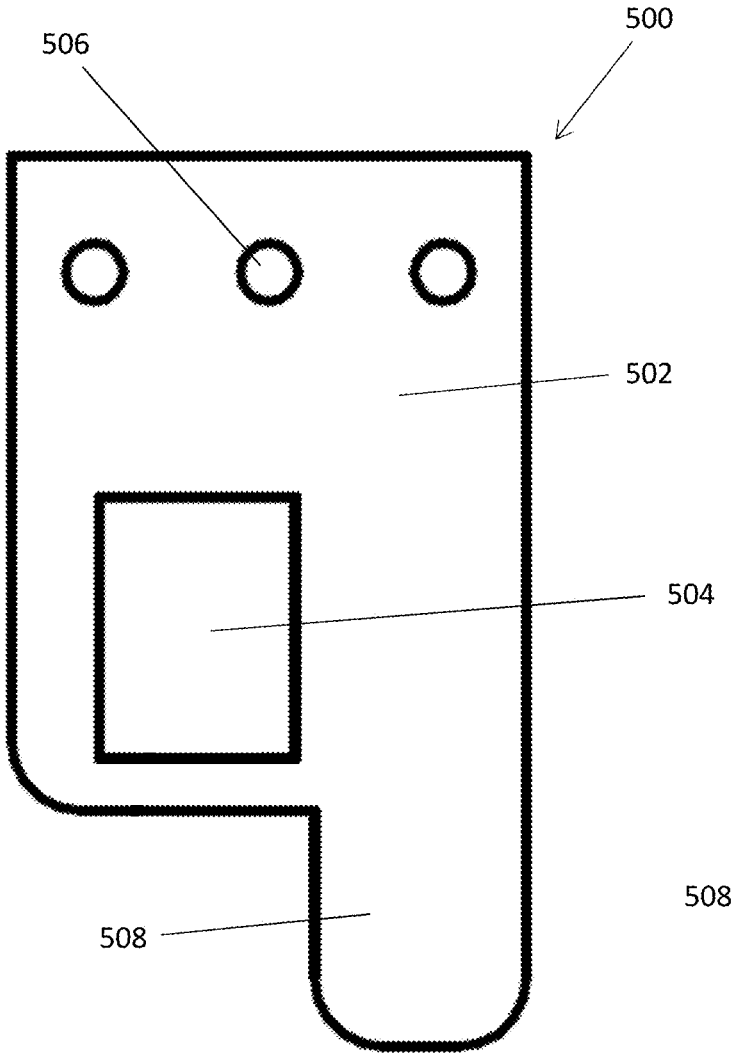
FIGS. 12 and 13 are respectively a front view and a side view of a hasp of the locking mechanism, according to some embodiments of the present invention.
Figure 13:
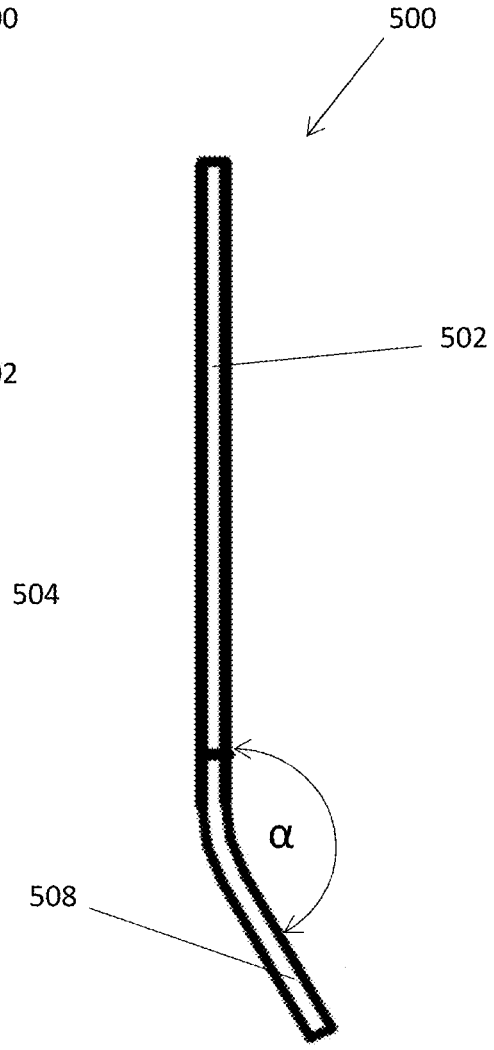

FIGS. 12 and 13 are respectively a front view and a side view of a hasp 500 of the locking mechanism, according to some embodiments of the present invention.

The hasp includes a flat panel 502 having an aperture 504. The hasp 500 is configured to be joined to the lid and extend towards the lid. In some embodiments of the present invention, the hasp is perpendicular to the lid. As will be shown later, the aperture 504 is configured to receive the prong of the latch. In the embodiment in which the lid has a front wall, the flat panel 506 has one or more holes 506 configured for being traversed by respective bolts or screws, for joining the hasp 500 to the front wall of the of the lid.

In some embodiments of the present invention, the hasp 500 includes a flap 508 extending downwards and inwards toward the back of the lid from the bottom of the flat panel 502 at a non-zero angle with the flat panel 502. The flap is configured to guide and ensure that the hasp 500 is guided to the inside of the latch, so the latch can grab and lock the lid in place once the lid is closed. In a non-limiting example of the present invention, the angle $\alpha$ between the flat panel 502 and flap 508 is between 2 and 45 degrees, for example between 25 and 28 degrees.

Figure 14:
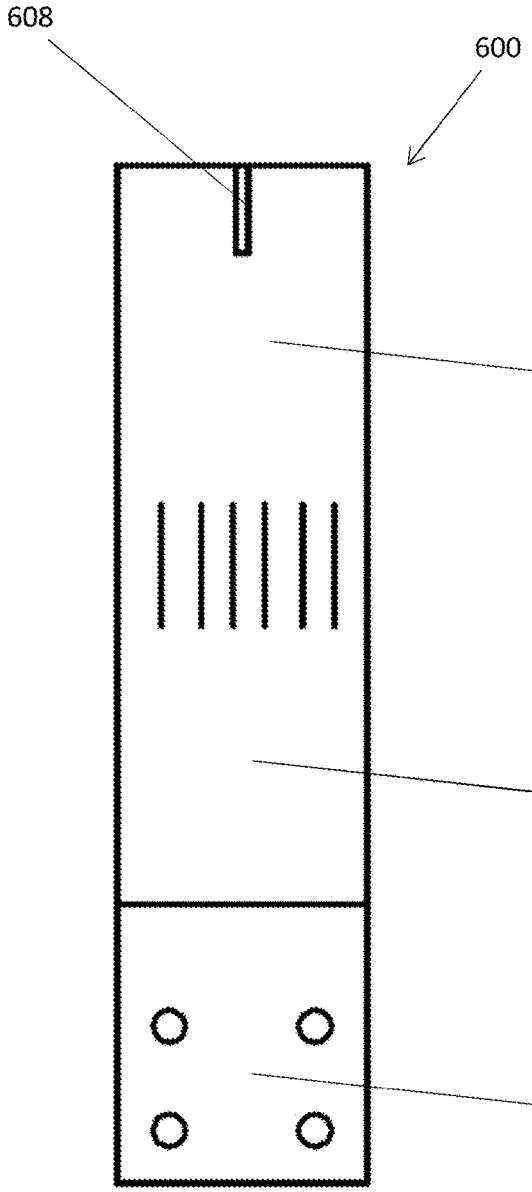
FIGS. 14 and 15 are respectively a front view and a side view of a latch of the locking mechanism, according to some embodiments of the present invention.
Figure 15:
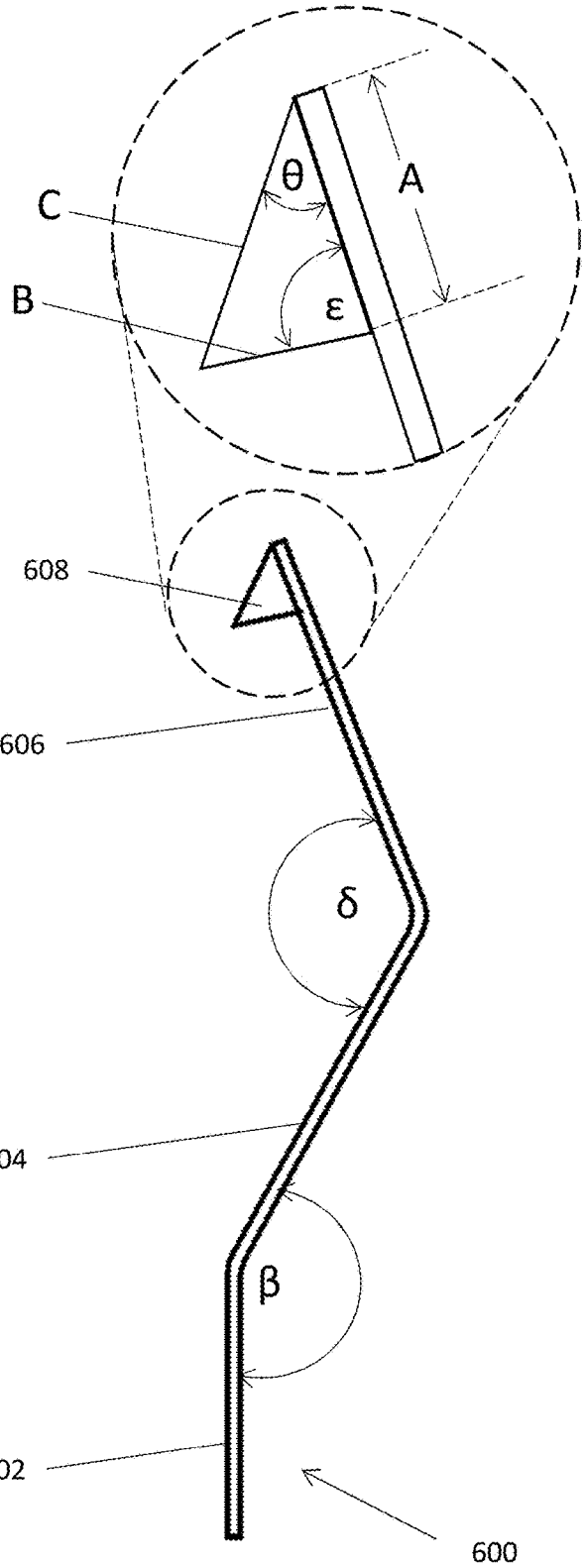

FIGS. 14 and 15 are respectively a front view and a side view of a latch 600 of the locking mechanism, according to some embodiments of the present invention.

The latch 600 has a bottom section 602, a middle section 604, and a top section 606. Each section includes a flat panel. The bottom section 602 is parallel to the front wall of the bin and is configured to be joined to inner face of the front wall of the bin, for example via one more screws/bolts traversing one or more holes 603 on the first section. The middle section 604 is oriented diagonally backward (toward the back of the bin). According to a non-limiting example, the angle $\beta$ between the bottom section 602 and the middle section 604 is between 0 and 160 degrees. For example, the angle $\beta$ may be larger than 90 degrees, and optionally between 150 and 153 degrees. The top section 606 is oriented diagonally forward toward the front wall of the bin. According to a non-limiting example, the angle $\delta$ between the middle section 604 and the top section 606 is between 110 and 150 degrees, for example between 130 and 132 degrees.

A prong 608 extends forward (toward the front wall of the bin) from the front face of the top section 606. The prong 608 has at least three sides, but may have more. A first side. A is joined flush with the front surface of the top section 606. A second side B extends forward from the bottom of the first side A. A third side C extends forward from the top of the first side A. According to a non-limiting example, the angle $\varepsilon$ between the sides A and B is between 70 to 90 degrees, for example between 80 and 81 degrees, while the angle $\theta$ between the sides A and C is between 38 and 55 degrees, for example between 46 and 47 degrees.

When the front of the lid approaches the front of the bin, the hasp 500 slides along the prong 608 and moves the prong 608 backwards, away from the front wall of the bin. This is due to the acute angle $\theta$. Then, the prong 608 is caught inside and traverses the aperture 504 of the hasp 500 and returns to touch the front wall of the bin, thereby locking the lid to the bin. If a thief tried to open the lid by pulling the lid up, the prong 608 would still be caught in the aperture 504 of the hasp 500. Because of the size of the angle $\varepsilon$, the bottom side of the aperture 504 would encounter resistance from the prong 608 and would not be able to slide along the side B of the prong 608. In this manner, the system 100 would offer resistance to a thief trying to open the lid. The thief would have to resort to more violent, noisy, and time-consuming methods to try to open the lid to access a package. This would discourage many thieves, who would fear these methods would expose them.

Figure 16A:
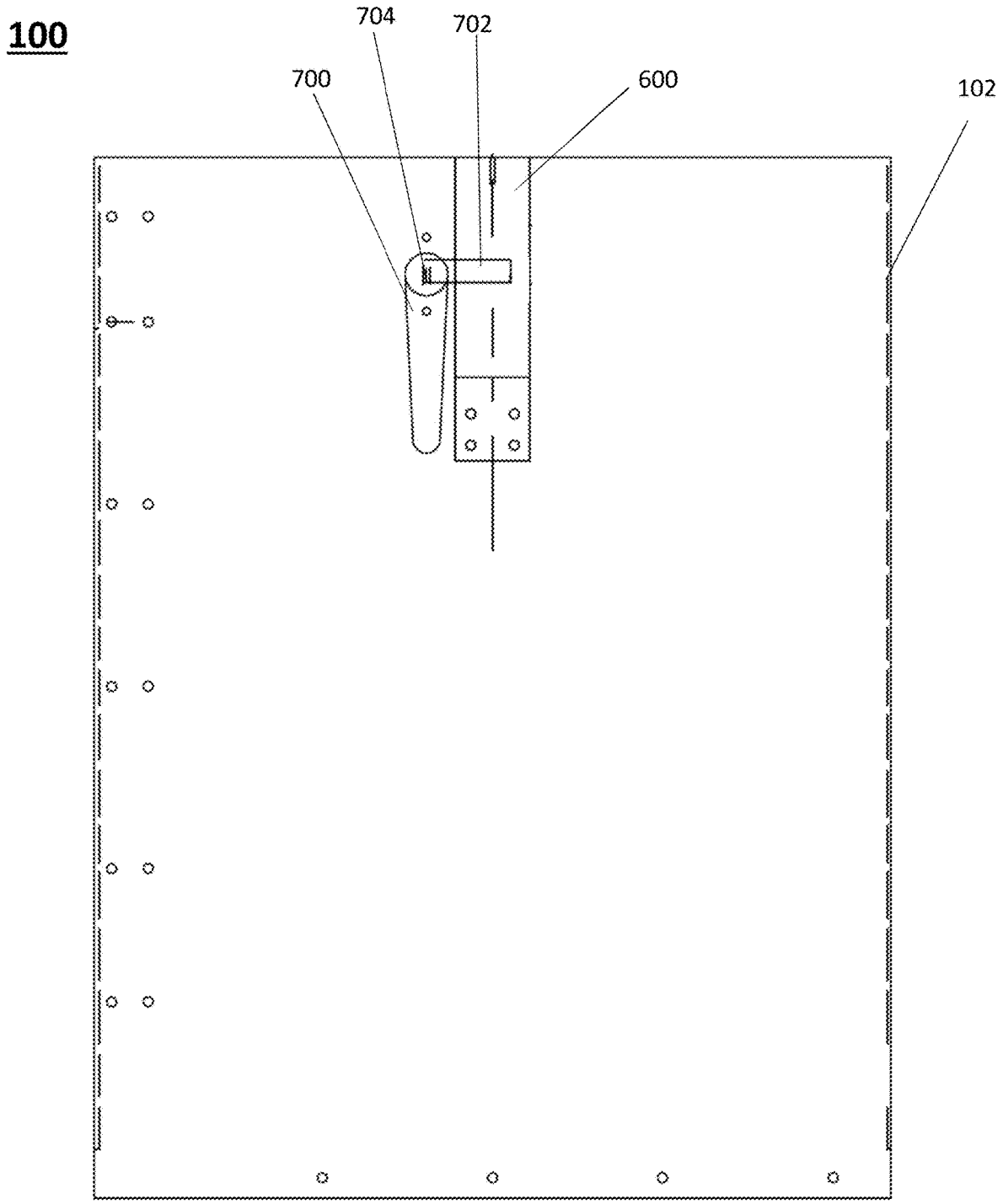
FIGS. 16*a*, 16*b*, and 16*c* are front views of different examples of unlocking mechanisms configured to unlock the lid from the bin, according to some embodiments of the present invention.
Figure 16B:
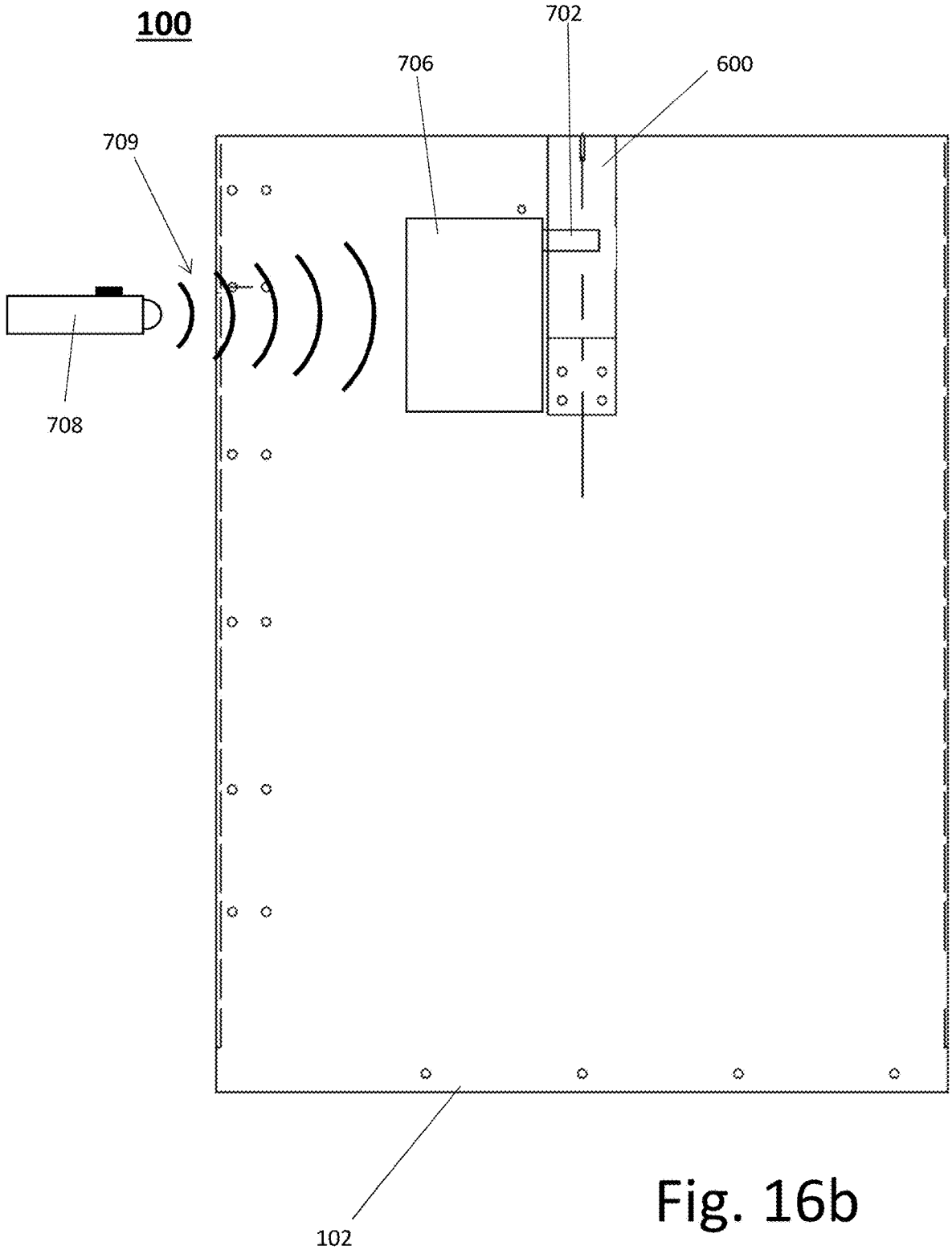
Figure 16C:
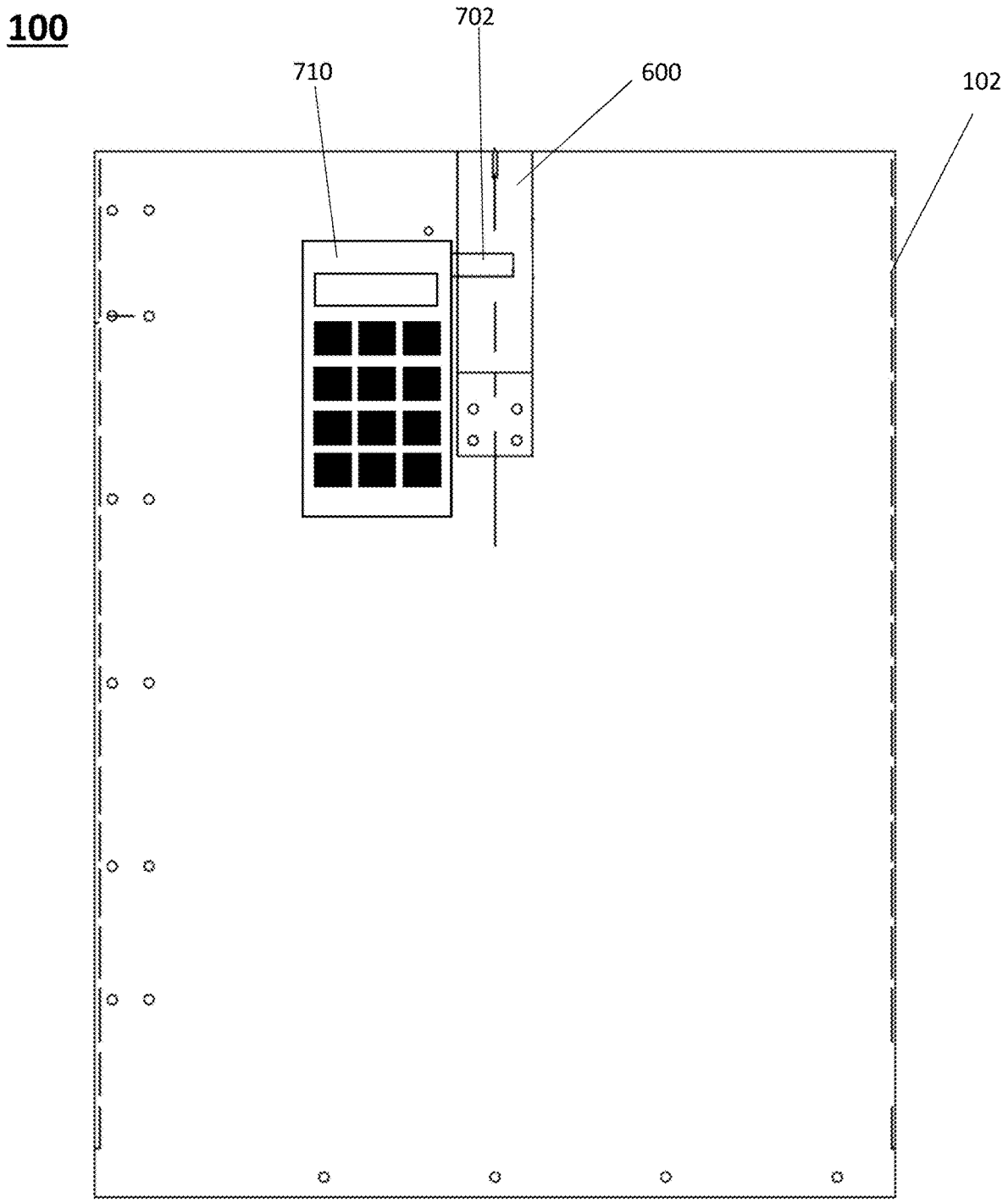
Figure 17:
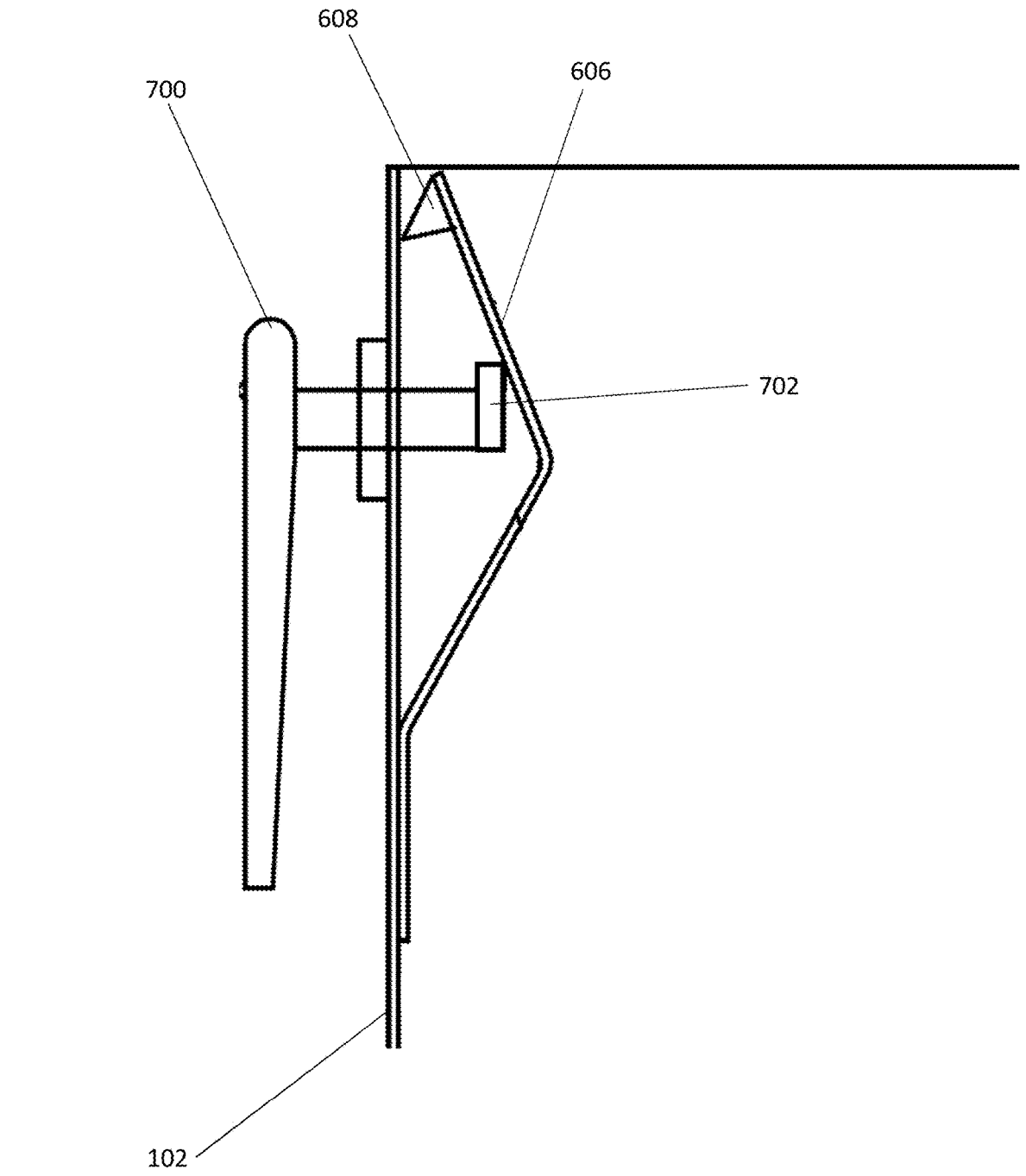
FIG. 17 is a side cross sectional view of the unlocking mechanism in a locked configuration thereof, according to some embodiments of the present invention.
Figure 18:
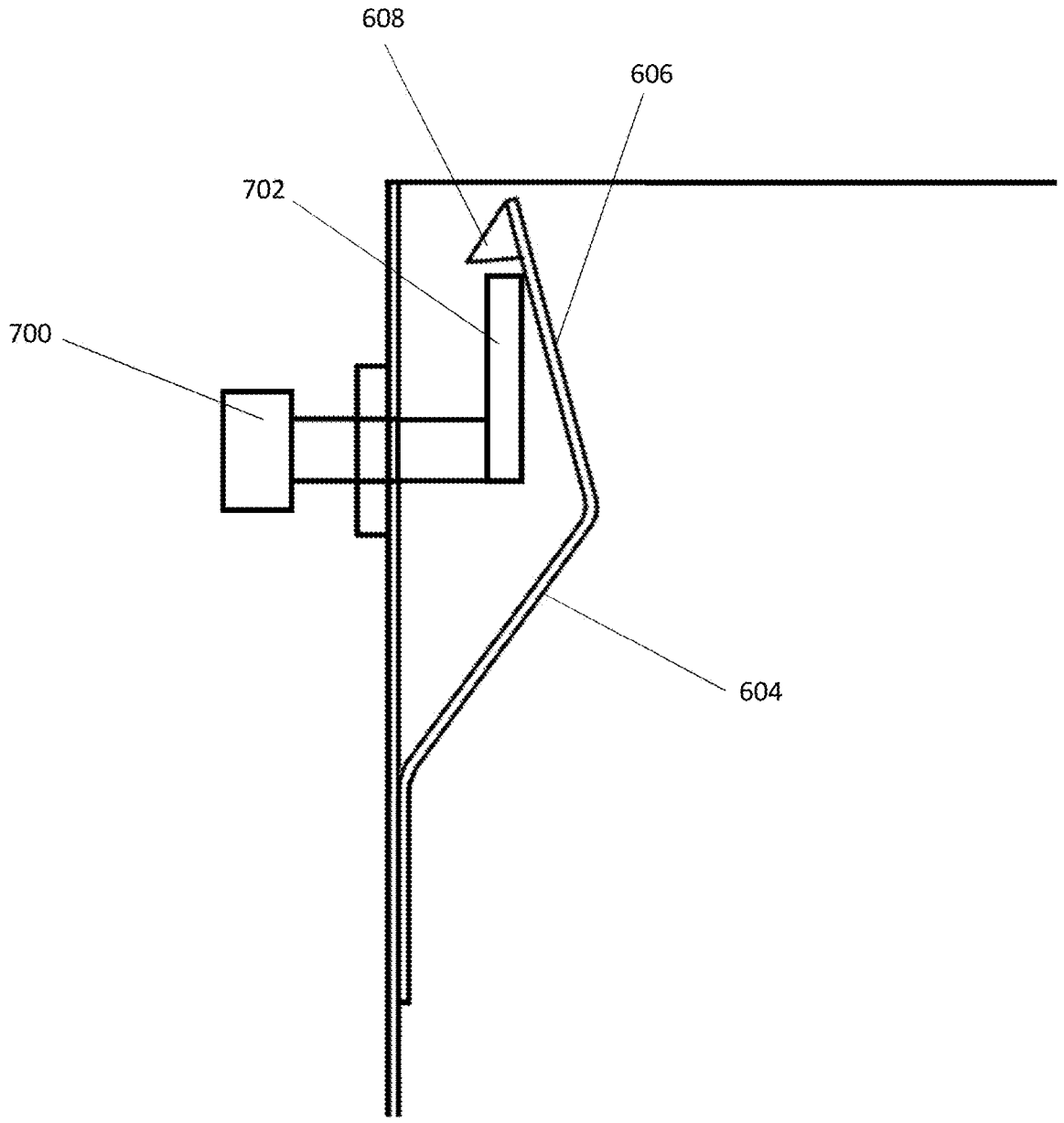
FIG. 18 is a side cross sectional view of the unlocking mechanism in an unlocked configuration thereof, according to some embodiments of the present invention.

FIGS. 16*a*-16*c* are front views of different examples of unlocking mechanisms configured to unlock the lid from the bin, according to some embodiments of the present invention. FIG. 17 is a side cross sectional view of the unlocking mechanism of FIG. 16*a* in a locked configuration thereof, according to some embodiments of the present invention. FIG. 18 is a side cross sectional view of the unlocking mechanism of FIG. 16*b* in an unlocked configuration thereof, according to some embodiments of the present invention.

The unlocking mechanism includes a turning unit and an elongated unlatcher 702. The turning unit is accessible to the recipient. The unlatcher 702 is located inside the bin 102, in the void between the latch 600 and the front wall of the bin 102.

In a first mode of the unlocking mechanism (FIGS. 16*a*, 16*b*, 16*c*, and 17), the unlatcher is substantially horizontal, with the long side of the unlatcher being horizontal. In this manner, the unlatcher 700 remains in the void between the latch 600 and the front wall of the bin 102. In a second mode of the unlocking mechanism (FIG. 18), unlatcher 702 is rotated vertically via the turning unit 700, so the long side of the unlatcher is vertical. In this manner the unlatcher contacts the top section 606 of the latch 600 and pushes the middle section 604 and the top section 606 away from the front wall of the bin 102. In this manner the prong 608 is pushed backwards out of the aperture of the hasp. Thus, the hasp is released from the prong and the lid may be opened.

The turning unit is configured to be accessible to the recipient from the outside of the bin 102 and is configured to turn the unlatcher 702 inside the bin 102. In a variant illustrated in FIG. 16*a*, the turning unit includes a handle 700 configured for being manually rotated by the recipient. The rotation of the handle 700 is enabled only when a key in the possession of the recipient is inserted into a keyhole 704 associated with the turning unit. In another variant illustrated in FIG. 16*b*, the turning unit includes an automatic unit 706 that is configured for rotating the unlatcher when activated by an electromagnetic signal 709 emitted by a controller 710 in possession of the recipient. In yet another variant illustrated in FIG. 16*c*, the turning unit includes a keypad 710 outside the bin 102, and is configured for rotating the unlatcher when the recipient enters a predetermined code onto the keypad 710. It should be noted that the turning unit may have other configurations, and the scope of the present invention extends to any kind of turning unit that is accessible only to the recipient and is configured to be activated by the recipient to unlock the front of the lid from the front of the bin.

FIGS. 19-25 relate to a multi-bin package storage system 800.

Figure 19A:
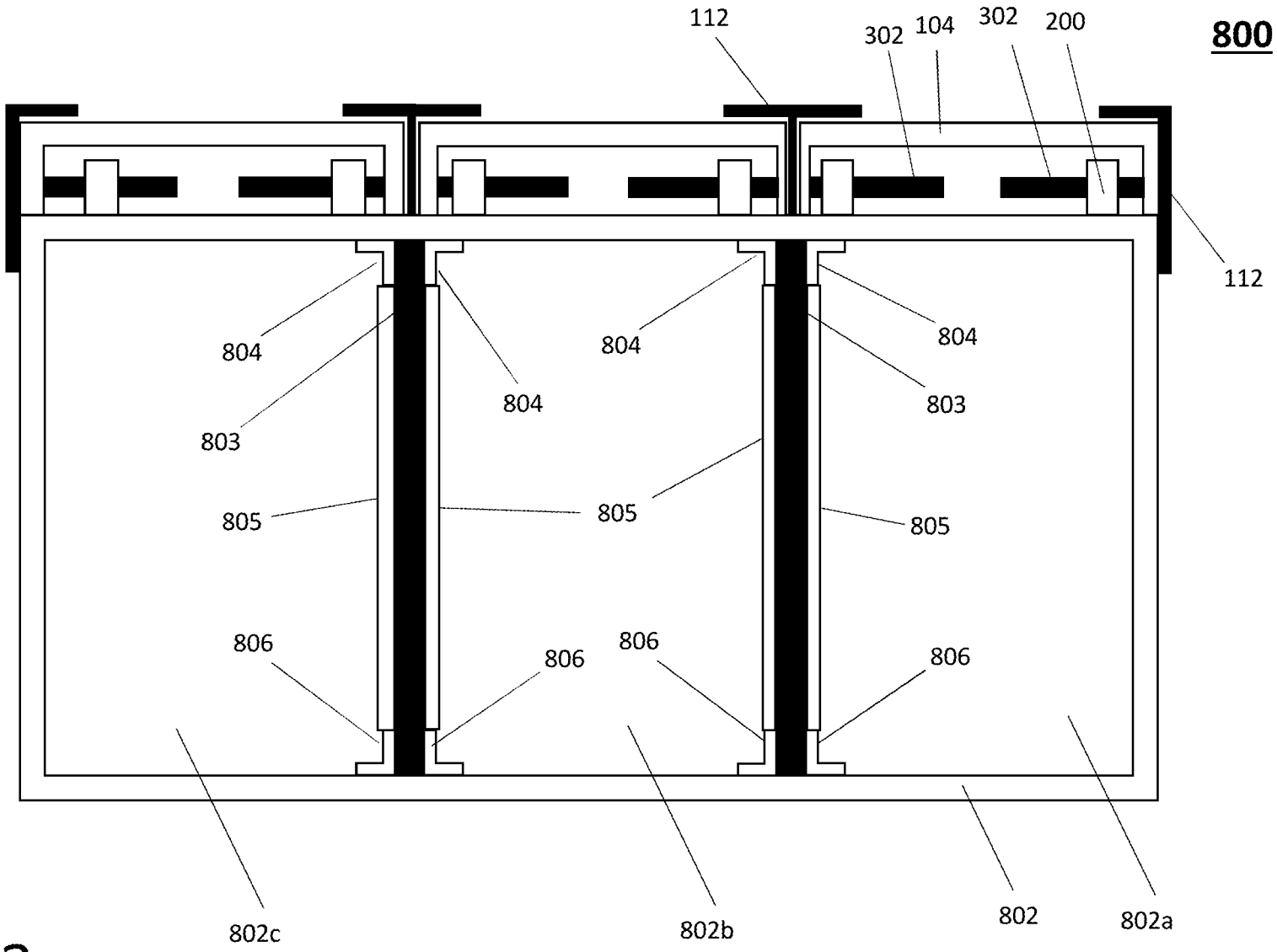
FIGS. 19*a* and 19*b* are top cross sectional views of a multi-bin package storage system, according to some embodiments of the present invention.
Figure 19B:
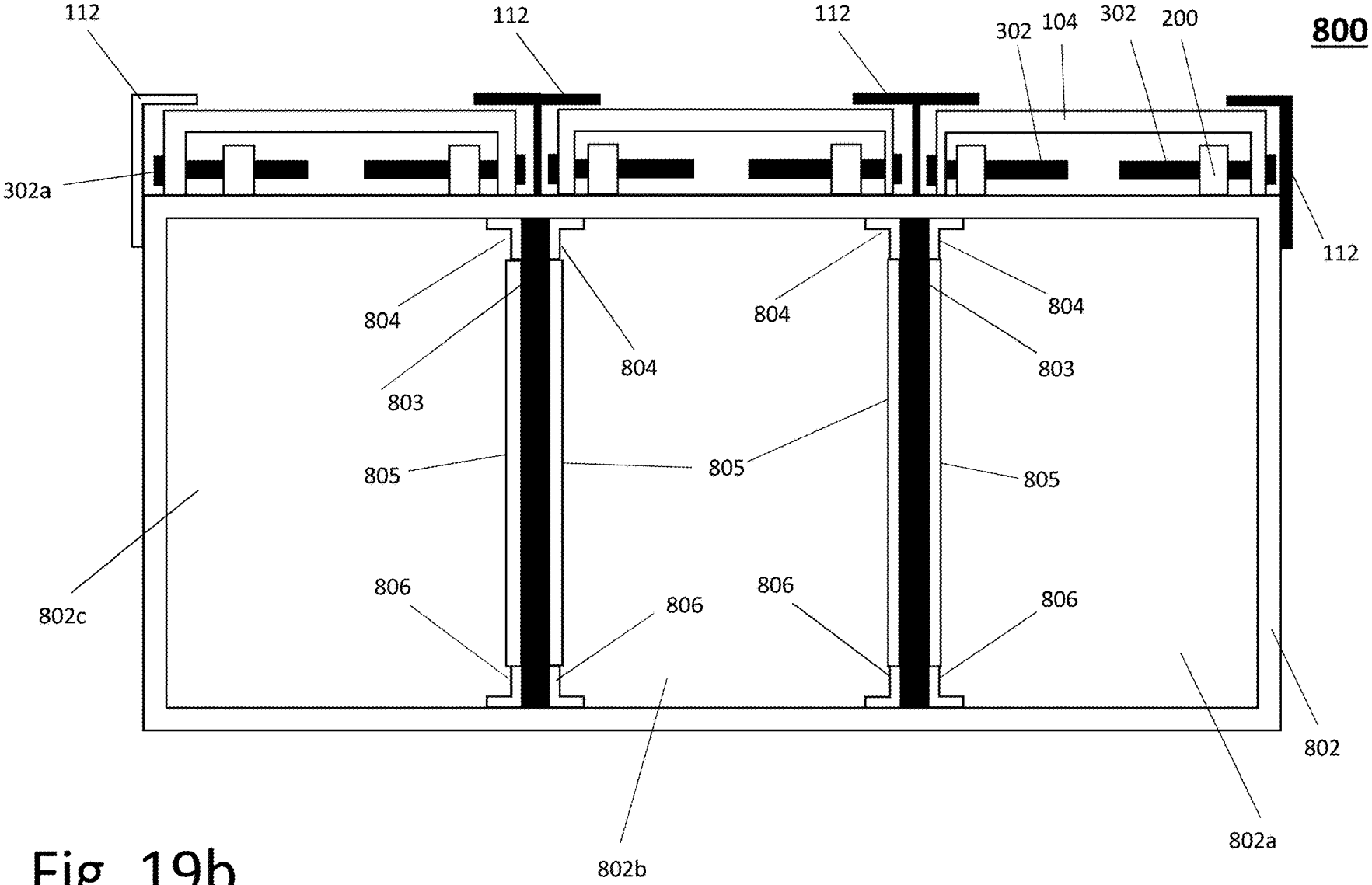

FIGS. 19*a* and 19*b* are top cross sectional views of a multi-bin package storage system 800, according to some embodiments of the present invention. In the example of FIG. 19*b*, the pins 302 of the lid include pin heads 302*a* extending laterally from the lids 104. Therefore, the lids 104 and lid retainers 112 are distanced from each other to enable the pin heads 302 to clear the lid retainers 112.

The system 800 includes a container 802 having an open top, a plurality of lids 104 and one or more dividers 803. The lids 104 are the same as the lids 104 described above. The dividers 803 include panels placed between a front wall and back wall of the container 802 and divide the container into separate storage sections 802*a*, 802*b*, and 802*c*. Each lid closes a respective separate section and may be opened and closed independently of the other lids.

The system 100 also includes a plurality of hinge brackets 200, configured to guide the lids 104 from a tucked mode behind the container 802 to a closed mode covering the top of container 802, as explained above. The system 800 includes a plurality of locking and unlocking mechanism, each configured to lock and unlock a respective lid 104 with the container 802. In some embodiments of the present invention, the system 800 includes a plurality of lid retainers 112, as described above.

In some embodiments of the present invention, at least one divider 803 is removable. The divider is propped up inside the container by a pair of back retainer brackets 804 and a pair of front retainer brackets 806. The back retainer brackets 804 are joined to the inner face of the back wall of the container 802. The front retainer brackets 806 are joined to the inner face of the front wall of the container 802. In some embodiments of the present invention, bottom retainer brackets 805 are bolted to the bottom of the bin and extend upwards. The back retainer brackets together with the bottom retainer brackets and the front retainer brackets formed a U-shaped pocket for the divider to reside in.

Figure 20:
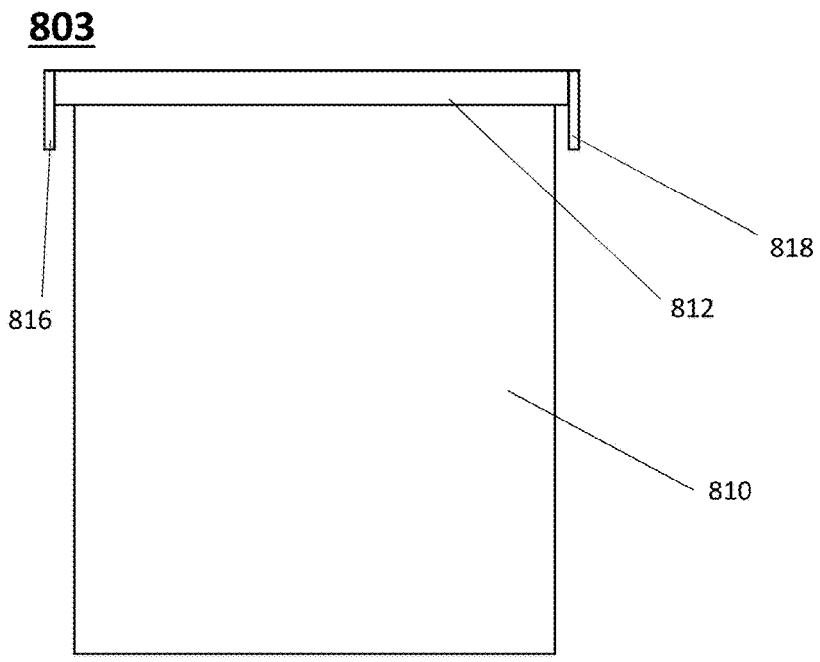
FIGS. 20-22 are different views of a removable divider panel, according of the present invention.
Figure 21:
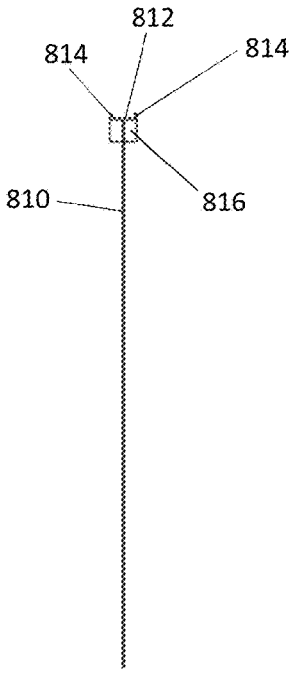
Figure 22:
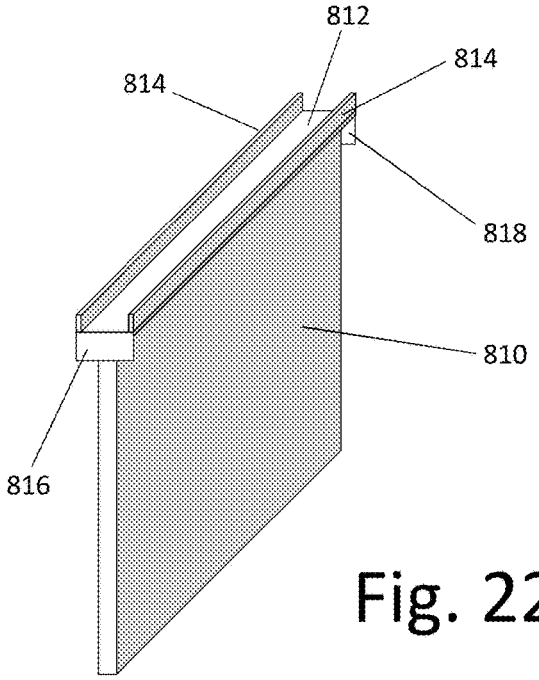

FIGS. 20-22 are different views of a removable divider 803, according of the present invention. FIG. 20 is a side view of the removable divider 803. FIG. 21 is a front view of the removable divider 803. FIG. 22 is an isometric view of the removable divider 803.

The removable divider 803 includes a plate 810 that serves as a wall between storage sections. The plate 810 may be, for example, a metal plate. In some embodiments of the present invention, a slab 812 is joined to the top of the plate 810 and is wider than the plate 810. Two protrusions 814 rise upward from the left end and the right end of the slab 812.

Optionally, the slab 812 is deeper than the plate 810, and includes a front tab 816 and rear tab 818. The tabs 816 and 818 extend downward from the front and rear ends of the slab 812. When removable panel 803 is joined to the container 802, the void between the front tab 816 and the plate 810 front catches a portion of the front wall of the container 802 and the void between the rear tab 818 and the plate 810 front catches a portion of the read wall of the container 802. In this manner, the removable divider 803 is solidly joined to the container 802.

Figure 23:
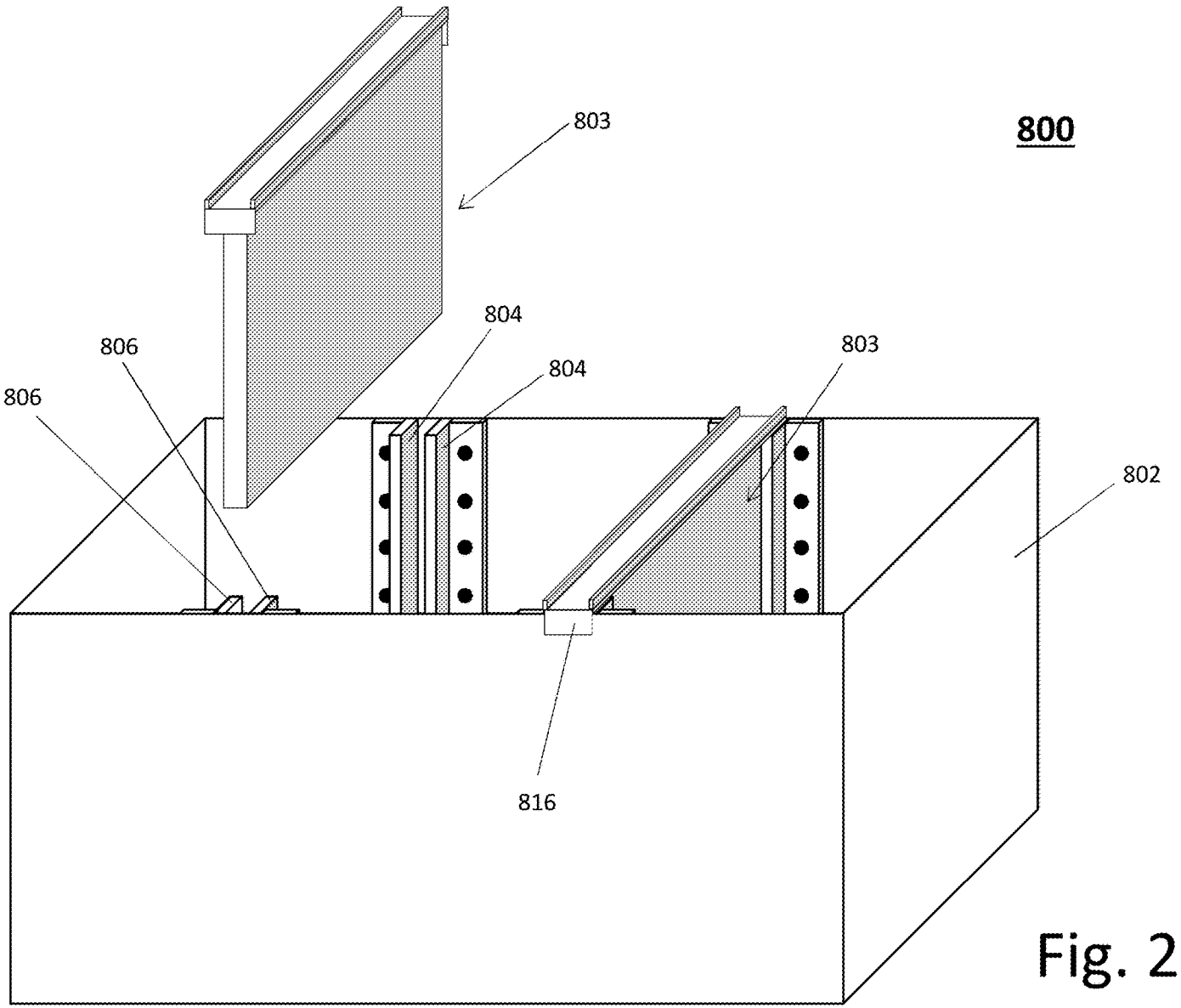
FIG. 23 is an isometric view of a bin of a multi-bin package storage system, having removable divider panels, according to some embodiments of the present invention.

FIG. 23 is an isometric view of a bin of a multi-bin package storage system 800, having removable divider panels 803, according to some embodiments of the present invention.

In FIG. 23, the removable panel 803 on the right hand side is maintained in the container 802, while the removable panel 803 on the left side is removed.

Figure 24:
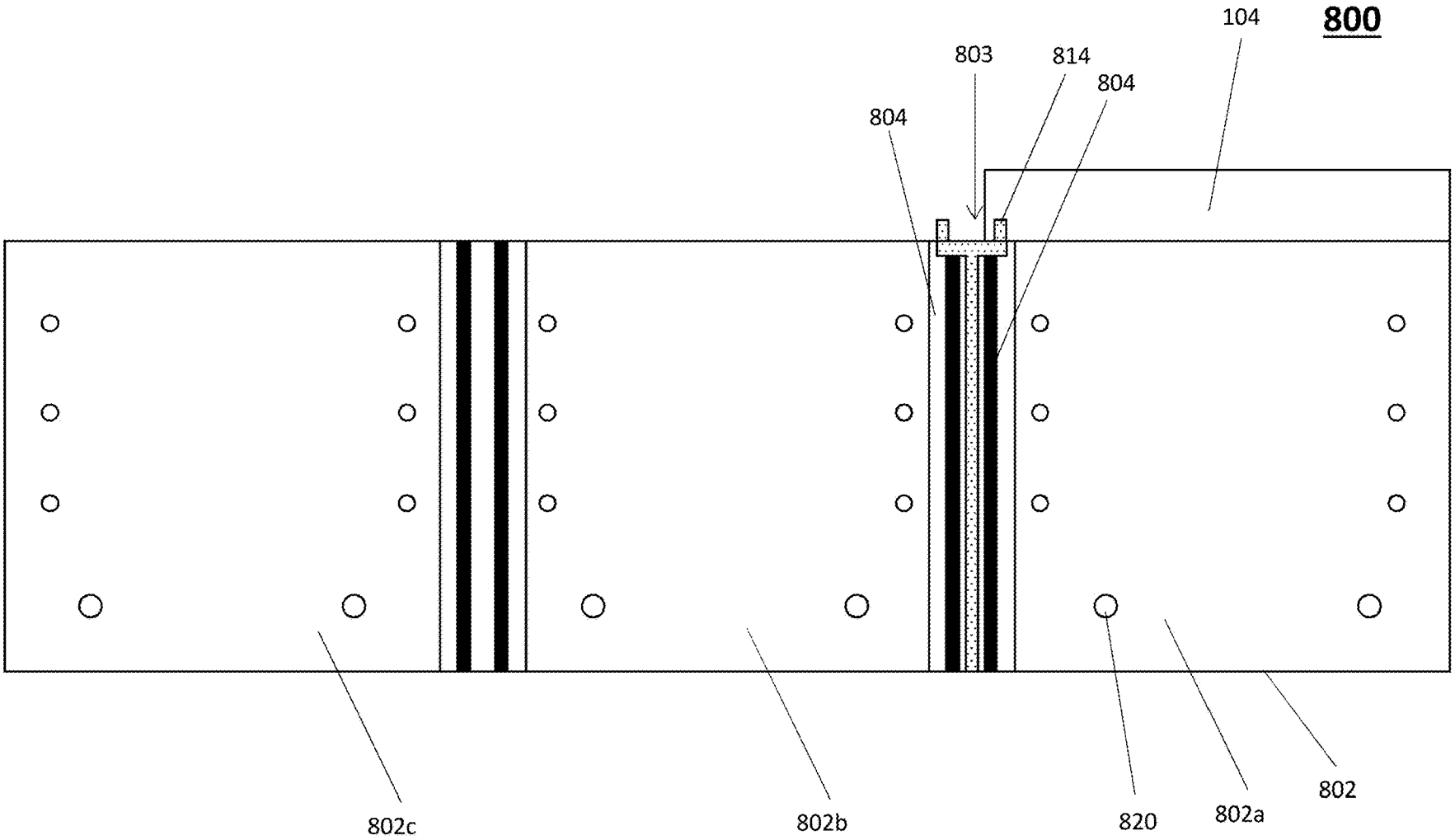
FIG. 24 is a cross sectional front view of a multi-bin package storage system having removable divider panels, according to some embodiments of the present invention.

FIG. 24 is a cross sectional front view of a multi-bin package storage system 800 having removable divider panels; according to some embodiments of the present invention.

In FIG. 24, the right divider panel 803 is kept in the container and separates the first container portion 802*a* front the second container portion 802*b*. The divider panel on the left hand side has been removed, so that the second container portion 802*b* and the third container portion 802*c* form together a single lager container portion configured to receive larger packages. It should be noted that while the lids are open, the divider panels are not locked and can be removed from the retainer brackets or placed in the retainer brackets by the delivery person. This enables the delivery person to adjust the size of the container portions according to a size of the package being delivered.

It should be noted that the removable divider panels 803 are located in the container 802, so that when a lid 104 closes a container portion bounded by the divider panel 803, one of the protrusions 814 covered by the by the lid. In this manner, even if the nearby lid is open, the divider panel is locked in place by the closed lid 104 and cannot be removed.

In some embodiments of the present invention, the container 802 has perforations 820 at the back wall of the container. The perforations 820 are configured to be traversed by bolts/screws or any other similar unit, so as to enable the container to be secured to a wall.

Figure 25:
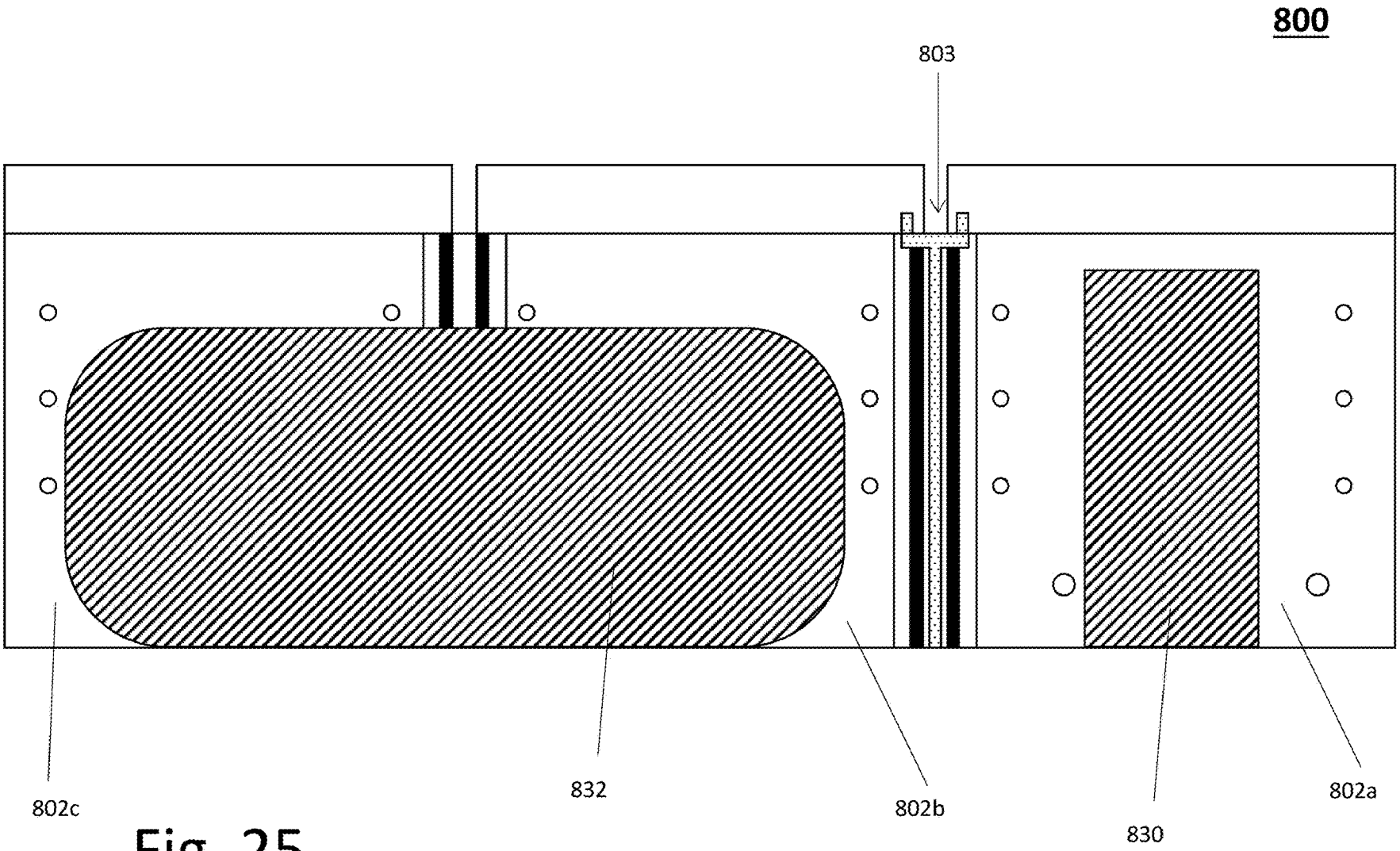
FIG. 25 is a cross sectional front view of a multi-bin package storage system having removable divider panels, showing how packages of different sizes are held by system, according to some embodiments of the present invention.

FIG. 25 is a cross sectional front view of a multi-bin package storage 800 system having removable divider panels 803, showing how packages of different sizes are held by system, according to some embodiments of the present invention.

As mentioned above, the removable divider panel 803 separates the container portion 802*a* from the container portion 802*b*, while the container portion 802*b* and container portion 802*c* are not separated and form a larger portion. Therefore, the container portion 802*a* can contain a smaller package 830, while the container portion formed by the portions 802*b* and 802*c* may contain a larger package 832. It should be noted that the larger portion formed by portions 802*b* and 802*c* is closed by two lids.

Figure 26:
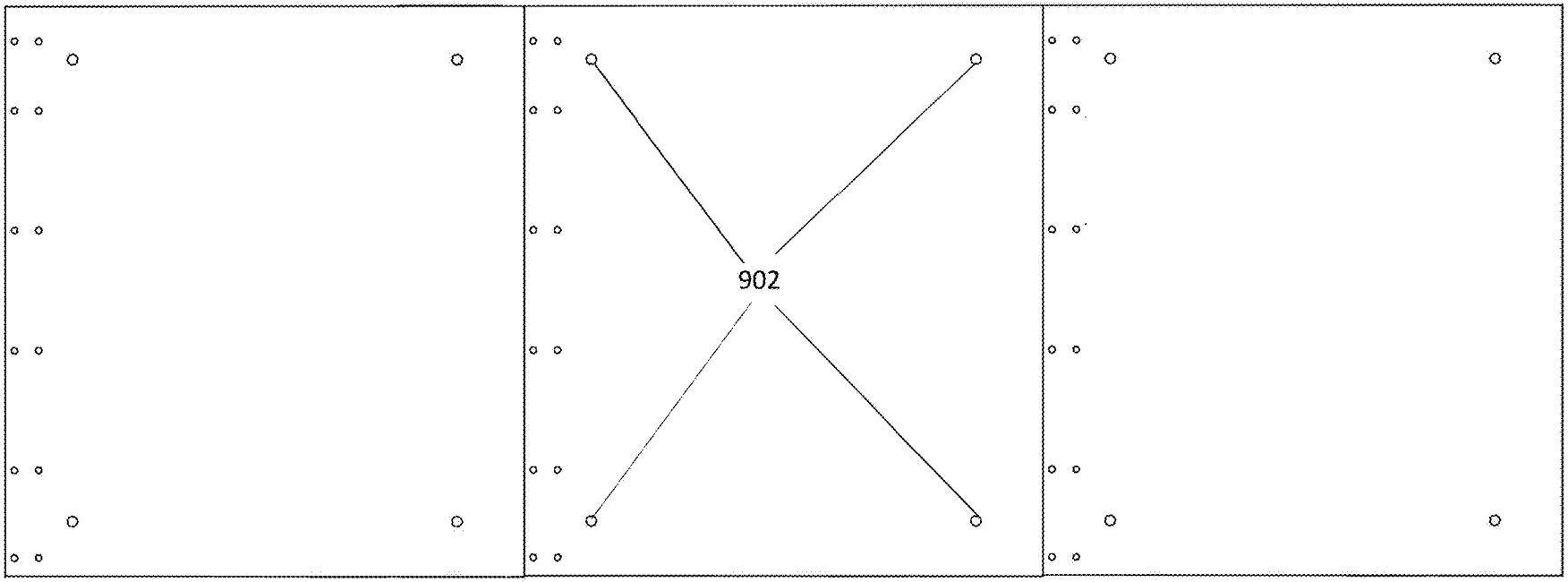
FIG. 26 is top view of a base configured to anchor the package storage system of the present invention to a floor, according to some embodiments of the present invention.

FIG. 26 is top view of a base 900 configured to anchor the package storage system of the present invention to a floor, according to some embodiments of the present invention.

The base 900 includes a perforated panel having perforations 902. The perforations 902 are aligned with the perforations on the floor of a container of a multi-bin system 800, and with perforations on the floor of a bin of a single-bin system 100. In this manner, the base may serve as a base for a single multi-bin system 800 or a plurality of single-bin systems adjacent to each other. Screws, bolts, or any similar units may traverse the perforations 902 and the perforations of the systems 800 and 100, to secure the system 800 and 100 to the floor of the recipient's porch.

What is claimed is:

1. A storage system for receiving and storing a package, the storage system comprising:

a bin, configured for receiving the package;

a lid, hingedly joined to a back of the bin, and configured for closing the bin;

a locking mechanism comprising a first device joined to a front wall of the bin and a second device joined to the lid, the locking mechanism being configured for automatically locking the first device to the second device, thereby locking the lid with the front wall of the bin when the lid closes the bin;

an unlocking mechanism, accessible to a recipient of the package and configured for unlocking the first device from the second device in response to an action by the recipient, thereby unlocking the lid from the front of the bin; and at least one hinge bracket joined to an outer surface of a back wall of the bin;

wherein:

the hinge bracket comprises an elongated panel extending away from the back wall of the bin, the elongated panel extending substantially vertically and having a slit closed at both ends and extending vertically in the panel;

the lid comprises a pin extending horizontally in proximity of a back of the lid;

the slit of the hinge bracket is configured to be traversed by the pin, thereby joining the lid to the bin, while constraining a motion of the lid to vertical motion along the slit and rotational motion around the pin.

2. The storage system of claim 1, wherein the bin is configured to be secured to a horizontal floor and/or a vertical wall outside a residence of the recipient.

3. The storage system of claim 1, further comprising a lid retainer joined to a first side or to a back of the bin in proximity of the first side, the lid retainer extending backwards away from the bin for a certain extension length and bending toward a second side of the bin opposite to the first side at an end of the extension length, such that the lid retainer prevents the lid from rotating backward when the pin of the lid is below the lid retainer.

4. The storage system of claim 3, wherein the lid retainer is above a bottom end of the slit and below a top end of the slit.

5. The storage system of claim 1, wherein:

the first device of the locking mechanism comprises a latch joined to an inner surface of the front wall of the bin;

the second device comprises a hasp joined to the lid and located near a front of the lid;

the hasp comprises a flat panel extending away from lid toward the bin, the flat panel having an aperture;

the latch comprises a bottom section a middle section, a top section, a prong;

the bottom section is parallel to the front wall of the bin and is joined to an inner face of the front wall of the bin;

the middle section is oriented diagonally backward with respect to the bottom section, at a first non-zero angle with respect to the bottom section;

the top section is oriented diagonally forward with respect to the middle section, at a second non-zero angle with respect to the middle section;

the prong extends forward from a front face of the top section to contact the front wall of the bin, the prong having a top side inclined downwards from a top of the top section toward the front wall of the bin and a bottom side;

as the front of the lid approaches the front wall of the bin, the hasp is configured to slide along the inclined top side of the prong and move the top section and the middle section of the latch backwards, away from the front wall of the bin, until the aperture of the hasp is aligned with the prong, at which point, the prong traverses the aperture and the latch is configured to snap back to return toward front wall;

once the prong is caught in the aperture of the hasp, lifting the lid causes the hasp to be push upwards against the bottom side of the prong;

the bottom side of the prong is oriented such that, when the hasp pushes upwards against the bottom side of the prong, the bottom side of the prong provides resistance against the upward movement of the prong and prevents the hasp from disengaging from the prong.

6. The storage system of claim 5, wherein the hasp comprises a flap extending at a third non-zero angle from a bottom of the panel downwards and backwards toward a back of the lid, the flap being configured to guide the hasp in a space between the latch and the front wall of the bin.

7. The storage system of claim 5, wherein:

the unlocking mechanism comprises a turning unit and an unlatcher;

the turning unit is accessible to the recipient;

the unlatcher is a located inside the bin, between the latch and the front wall of the bin;

in a first mode of the unlocking mechanism, the unlatcher is located in a void between the latch and the front wall of the bin;

in a second mode of the unlocking mechanism, the unlatcher is rotated to contact the top section of the latch and is configured to push the middle section and the top section backwards so the prong is pushed out of the aperture of the hasp, thereby disengaging the hasp from the prong and enabling the lid to be opened;

the turning unit is configured to turn the unlatcher between the first mode and the second mode via an action of the recipient.

8. The storage system of claim 7, wherein the turning unit comprises:

a handle located outside the front wall of the bin, and configured to be rotated, the handle being joined to the unlatcher via an opening in the front wall of the bin, such that a rotation of the handle in a rotation direction causes the unlatcher to rotate in the rotation direction; and a key mechanism having a keyhole associated with handle, such that the handle is able to be turned only when a key in possession of the recipient is inserted in the keyhole and turned.

9. The storage system of claim 7, wherein the turning unit comprises:

an automatic unit configured for turning the unlatcher in response to an electromagnetic signal emitted by a controller in possession of the recipient; or a keypad outside the bin and configured to rotate the unlatcher when the recipient enters a predetermined code in possession of the recipient.

10. A storage system for receiving and storing a package, the storage system comprising:

a bin, configured for receiving the package;

a lid, hingedly joined to a back of the bin, and configured for closing the bin;

a locking mechanism comprising a first device joined to a front wall of the bin and a second device joined to the lid, the locking mechanism being configured for automatically locking the first device to the second device, thereby locking the lid with the front wall of the bin when the lid closes the bin;

an unlocking mechanism, accessible to a recipient of the package and configured for unlocking the first device from the second device in response to an action by the recipient, thereby unlocking the lid from the front of the bin;

wherein:

the first device of the locking mechanism comprises a latch joined to an inner surface of the front wall of the bin;

the second device comprises a hasp joined to the lid and located near a front of the lid;

the hasp comprises a flat panel extending away from lid toward the bin, the flat panel having an aperture;

the latch comprises a bottom section a middle section, a top section, a prong;

the bottom section is parallel to the front wall of the bin and is joined to an inner face of the front wall of the bin;

the middle section is oriented diagonally backward with respect to the bottom section, at a first non-zero angle with respect to the bottom section;

the top section is oriented diagonally forward with respect to the middle section, at a second non-zero angle with respect to the middle section;

the prong extends forward from a front face of the top section to contact the front wall of the bin, the prong having a top side inclined downwards from a top of the top section toward the front wall of the bin and a bottom side;

as the front of the lid approaches the front wall of the bin, the hasp is configured to slide along the inclined top side of the prong and move the top section and the middle section of the latch backwards, away from the front wall of the bin, until the aperture of the hasp is aligned with the prong, at which point, the prong traverses the aperture and the latch is configured to snap back to return toward front wall;

once the prong is caught in the aperture of the hasp, lifting the lid causes the hasp to be push upwards against the bottom side of the prong;

the bottom side of the prong is oriented such that, when the hasp pushes upwards against the bottom side of the prong, the bottom side of the prong provides resistance against the upward movement of the prong and prevents the hasp from disengaging from the prong.

11. The storage system of claim 10, wherein the bin is configured to be secured to a horizontal floor and/or a vertical wall outside a residence of the recipient.

12. The storage system of claim 10, comprising at least one hinge bracket joined to an outer surface of a back wall of the bin, wherein:

the hinge bracket comprises an elongated panel extending away from the back wall of the bin, the elongated panel extending substantially vertically and having a slit closed at both ends and extending vertically in the panel;

the lid comprises a pin extending horizontally in proximity of a back of the lid;

the slit of the hinge bracket is configured to be traversed by the pin, thereby joining the lid to the bin, while constraining a motion of the lid to vertical motion along the slit and rotational motion around the pin.

13. The storage system of claim 12, further comprising a lid retainer joined to a first side or to a back of the bin in proximity of the first side, the lid retainer extending backwards away from the bin for a certain extension length and bending toward a second side of the bin opposite to the first side at an end of the extension length, such that the lid retainer prevents the lid from rotating backward when the pin of the lid is below the lid retainer.

14. The storage system of claim 13, wherein the lid retainer is above a bottom end of the slit and below a top end of the slit.

15. The storage system of claim 10, wherein the hasp comprises a flap extending at a third non-zero angle from a bottom of the panel downwards and backwards toward a back of the lid, the flap being configured to guide the hasp in a space between the latch and the front wall of the bin.

16. The storage system of claim 10, wherein:

the unlocking mechanism comprises a turning unit and an unlatcher;

the turning unit is accessible to the recipient;

the unlatcher is a located inside the bin, between the latch and the front wall of the bin;

in a first mode of the unlocking mechanism, the unlatcher is located in a void between the latch and the front wall of the bin;

in a second mode of the unlocking mechanism, the unlatcher is rotated to contact the top section of the latch and is configured to push the middle section and the top section backwards so the prong is pushed out of the aperture of the hasp, thereby disengaging the hasp from the prong and enabling the lid to be opened;

the turning unit is configured to turn the unlatcher between the first mode and the second mode via an action of the recipient.

17. The storage system of claim 16, wherein the turning unit comprises:

a handle located outside the front wall of the bin, and configured to be rotated, the handle being joined to the unlatcher via an opening in the front wall of the bin, such that a rotation of the handle in a rotation direction causes the unlatcher to rotate in the rotation direction; and a key mechanism having a keyhole associated with handle, such that the handle is able to be turned only when a key in possession of the recipient is inserted in the keyhole and turned.

18. The storage system of claim 16, wherein the turning unit comprises:

an automatic unit configured for turning the unlatcher in response to an electromagnetic signal emitted by a controller in possession of the recipient; or a keypad outside the bin and configured to rotate the unlatcher when the recipient enters a predetermined code in possession of the recipient.

* * * * *